US012799640B2

(12) United States Patent
Hu et al.

(10) Patent No.: US 12,799,640 B2
(45) Date of Patent: Nov. 17, 2026

(54) SYSTEMS, METHODS, AND DEVICES FOR CARBON MATERIAL UPGRADE AND ORGANIC COMPOUND PYROLYSIS

(71) Applicants: UNIVERSITY OF MARYLAND, COLLEGE PARK, College Park, MD (US); GEORGIA TECH RESEARCH CORPORATION, Atlanta, GA (US); The Johns Hopkins University, Baltimore, MD (US)

(72) Inventors: Liangbing Hu, Rockville, MD (US); Qi Dong, Newton, MA (US); Tangyuan Li, College Park, MD (US); Pedro Arias-Monje, Monterey, CA (US); Bodiuzzaman Jony, Portland, OR (US); Kishor Gupta, Johns Creek, GA (US); Satish Kumar, Atlanta, GA (US); Chao Wang, Ellicott City, MD (US); Canhui Wang, Moriches, NY (US); Pengfei Xie, Baltimore, MD (US)

(73) Assignees: UNIVERSITY OF MARYLAND, COLLEGE PARK, College Park, MD (US); GEORGIA TECH RESEARCH CORPORATION, Atlanta, GA (US); THE JOHNS HOPKINS UNIVERSITY, Baltimore, MD (US)

( * ) Notice: Subject to any disclaimer, the term of this patent is extended or adjusted under 35 U.S.C. 154(b) by 482 days.

(21) Appl. No.: 18/562,471

(22) PCT Filed: May 23, 2022

(86) PCT No.: PCT/US2022/030555
§ 371 (c)(1),
(2) Date: Nov. 20, 2023

(87) PCT Pub. No.: WO2022/246325
PCT Pub. Date: Nov. 24, 2022

(65) Prior Publication Data
US 2024/0301591 A1 Sep. 12, 2024

Related U.S. Application Data

(60) Provisional application No. 63/191,917, filed on May 21, 2021.

(51) Int. Cl.
*D01F 9/22* (2006.01)
*D01D 5/06* (2006.01)
(Continued)

(52) U.S. Cl.
CPC ..... *D01F 9/22* (2013.01); *D01D 5/06* (2013.01); *D01D 5/14* (2013.01); *D01F 9/328* (2013.01); *D10B 2101/12* (2013.01)

(58) Field of Classification Search
CPC ... D01F 9/22; D01F 9/328; D01F 9/00; D01F 9/08; D01F 9/12; D01F 9/14; D01F 9/32;
(Continued)

(56) References Cited

U.S. PATENT DOCUMENTS 5,348,774 A * 9/1994 Golecki ..... C04B 35/83 427/255.6
5,527,518 A 6/1996 Lynum et al.
(Continued)

FOREIGN PATENT DOCUMENTS

JP 2006-335624 A 12/2006

OTHER PUBLICATIONS

Ahn, et al., Properties of Conductive Polyacrylonitrile Fibers Prepared by Using Benzoxazine Modified Carbon Black, Polymers 2020; 12: 179—pp. 1-12 (Year: 2020).*
(Continued)

*Primary Examiner* — Daniel C. McCracken
(74) *Attorney, Agent, or Firm* — RowanTree Law Group, PLLC; Frederick F. Rosenberger

(57) ABSTRACT

A carbon material can comprise a porous scaffold of carbon fibrils and particles of carbon black attached to the carbon fibrils. The carbon material can be provided in an atmosphere of a gas comprising one or more organic compounds,
(Continued)

for example, methane. The carbon material and the gas can be subjected to a temperature (e.g., 1700 K) that causes the organic compound(s) to undergo pyrolysis to form carbon and hydrogen. For example, the carbon material can be used as a Joule heating element to heat the material and the gas to the pyrolysis temperature. At least some of the formed carbon can be deposited on or within the carbon material. As a result, the carbon fibrils in the material can merge to form a carbonized matrix, and the carbon black particles can become embedded within the carbonized matrix.

20 Claims, 13 Drawing Sheets

(51) Int. Cl.
*D01D 5/14* (2006.01)
*D01F 9/32* (2006.01)

(58) Field of Classification Search
CPC ..... D01F 9/324; D01F 9/326; D01F 11/00; D01F 11/02; D01F 11/04; D01F 11/06; D01F 11/08; D01F 11/10; D01F 11/12; D01F 11/121; D01F 11/122; D01F 11/123; D01F 11/124; D01F 11/125; D01F 11/126; D01F 11/127; D01F 11/128; D01F 11/129; D01F 11/14; D01F 11/16; D01D 5/06; D01D 5/14; D10B 2101/12; D06M 2101/40; D06M 10/003; D06M 10/005; D06M 10/008; D06M 10/025; D06M 10/08; D06M 11/74; D06M 13/02; C01B 2203/0272; C01B 2203/0405; C01B 2203/085; C01B 3/24
See application file for complete search history.

(56) References Cited

U.S. PATENT DOCUMENTS

| | | | | |
|---|---|---|---|---|
| 5,747,096 | A * | 5/1998 | Golecki ..... | C23C 16/52 427/591 |
| 6,255,234 | B1 * | 7/2001 | Erdemir ..... | F16C 33/16 442/140 |
| 8,092,778 | B2 | 1/2012 | Zhu et al. | |
| 9,732,445 | B2 | 8/2017 | Rios et al. | |
| 2016/0319110 | A1 | 11/2016 | Matheu et al. | |
| 2017/0073522 | A1 | 3/2017 | Hardman et al. | |
| 2020/0002165 | A1 | 1/2020 | Desai et al. | |
| 2022/0098762 | A1 | 3/2022 | Desai et al. | |

OTHER PUBLICATIONS

Gomes, et al., The incorporation of carbon black particle into electrospun nanofiber, IEEE 2014 29th Symposium on Microelectronics Technology and Devices (SBMicro), DOI: 10.1109/SBMicro.2014.6940091, pp. 1-3 (Year: 2014).*

Delhaes, Review Chemical vapor deposition and infiltration processes of carbon materials, Carbon 2002; 40: 641-657 (Year: 2002).*

International Search Report and Written Opinion, mailed Nov. 16, 2022, in International Application No. PCT/US22/30555. (11 pages).

EP Office Action, issued Aug. 7, 2025 (Aug. 7, 2025), in European Application No. 22805665.1. (13 pages).

Zheng et al., "Scalable Manufacturing of Carbon Nanotubes on Continuous Carbon Fibers Surface from Chemical Vapor Deposition," *Vacuum*, 2018 (online Mar. 8, 2018), 152: pp. 84-90. (7 pages).

* cited by examiner

SYSTEMS, METHODS, AND DEVICES FOR CARBON MATERIAL UPGRADE AND ORGANIC COMPOUND PYROLYSIS

CROSS-REFERENCE TO RELATED APPLICATION(S)

The present application claims the benefit of U.S. Provisional Application No. 63/191,917, filed May 21, 2021, entitled "Enhanced Carbon Fiber and Methods of Making and Using the Same," which is incorporated by reference herein in its entirety.

STATEMENT REGARDING FEDERALLY SPONSORED RESEARCH

This invention was made with government support under DE-AR0001191 awarded by the U.S. Department of Energy. The government has certain rights in the invention.

FIELD

The present disclosure relates generally to organic compound conversion and carbon materials, such as carbon fibers, and more particularly, to upgrading of carbon materials via organic compound pyrolysis.

BACKGROUND

While the continued discovery of natural gas reserves has led to an increasing methane ($CH_4$) supply, conventional methods of converting methane to hydrogen gas can suffer from low energy efficiency and excessive $CO_2$ emissions. For example, methane pyrolysis (e.g., $CH_4 \rightarrow C+2(H_2)$) offers the possibility of hydrogen production, but it requires a large energy input (e.g., $\Delta H=75.6$ kJ/mol) due to its endothermic nature. Due to limited heat transfer in furnace heating, conventional methane pyrolysis techniques demonstrate a low yield of $H_2$ and poor energy efficiency. Moreover, carbon species produced by the pyrolysis are typically of low quality and value (e.g., carbon black), the deposition of which can result in reactor blockage or otherwise result in reduced efficiency. To reduce the energy requirements, conventional methane pyrolysis techniques often employ expensive catalysts to facilitate the reaction, in particular, to achieve high hydrogen yield at more modest temperatures (e.g., ~1000K). However, such supported or molten metal catalysts (e.g., Ni, Co, Fe, Pt, Pd) can be prone to deactivation by the solid carbon (e.g., coking) resulting from the pyrolysis.

Embodiments of the disclosed subject matter may address one or more of the above-noted problems and disadvantages, among other things.

SUMMARY

Embodiments of the disclosed subject matter system provide a catalyst-free process for pyrolysis of one or more organic compounds, for example, methane. In some embodiments, the carbon black produced by the pyrolysis can be captured by a porous carbon material, while simultaneously producing hydrogen gas ($H_2$) with high selectivity (e.g., ~90%). In some embodiments, the captured carbon can serve to enhance or upgrade the carbon material to yield a more useful product, for example, by converting a low-quality carbon fiber (e.g., featuring low mechanical and/or electrical properties) to a high-quality carbon fiber (e.g., featuring higher mechanical and/or electrical properties) for example, by filling pores and healing defects within the low-quality carbon fiber. For example, the upgraded carbon fiber can exhibit a ten-fold increase in tensile strength and a twenty-fold increase in electrical conductivity as compared to the original low-quality carbon fiber. In some embodiments, the low-quality carbon fiber starting material can be produced from a mixture of fiber precursor (e.g., polyacrylonitrile (PAN)) and carbon black particles, for example, via dry-jet wet spinning. The use of carbon black particles (e.g., 20-80%, inclusive, of the low-quality fiber) can significantly reduce the costs associated with producing high-quality carbon fibers.

In one or more embodiments, a method can comprise providing a first material comprising a porous scaffold of carbon fibrils and particles of carbon black attached to the carbon fibrils. The method can further comprise subjecting the first material, in a first atmosphere of a gas comprising one or more organic compounds, to a first temperature for a first duration. The subjecting can be such that the one or more organic compounds undergo pyrolysis to form carbon and hydrogen, and at least some of the formed carbon being deposited on, within, or both on and within the first material. The subjecting can be further such that the carbon fibrils merge to form a carbonized matrix, and the carbon black particles become embedded within the carbonized matrix.

In one or more embodiments, a system can comprise a gas enclosure, an inlet line, a pair of electrodes, a current source, and a controller. The gas enclosure can be constructed to contain a first atmosphere of a gas comprising one or more organic compounds. The inlet line can comprise one or more inlet flow control devices and can be constructed to deliver the gas to the gas enclosure. The pair of electrodes can be disposed within the gas enclosure and can be constructed to be coupled to respective portions of one or more first materials. The current source can be coupled to the pair of electrodes. The controller can be operatively coupled to the one or more inlet flow control devices and the current source. The controller can comprise one or more processors and computer-readable storage media storing instructions that, when executed by the one or more processors, cause the controller to control the one or more inlet flow control devices to provide the first atmosphere to the gas enclosure, and control the current source to pass a first electrical current through at least part of each first material via the pair of electrodes so as to subject the at least part of each first material in the first atmosphere to a first temperature for a first duration. The subjecting to the first temperature can be such that the one or more organic compounds undergo pyrolysis to form carbon and hydrogen, and at least some of the formed carbon being deposited on, within, or both on and within the at least part of each first material. The subjecting to the first temperature can be further such that carbon fibrils within the at least part of each first material merge to form a respective carbonized matrix, and carbon black particles within the at least part of each first material become embedded within the respective carbonized matrix.

In one or more embodiments, a material for fabricating an upgraded carbon fiber can comprise a porous scaffold of carbon fibrils, and particles of carbon black within the porous scaffold and attached to the carbon fibrils. An amount of the carbon black particles within the material can be in a range of 20-80 wt %, inclusive. In some embodiments, an upgraded carbon fiber can be formed at least in part by subjecting the material, in an atmosphere of a gas comprising one or more organic compounds, to a first temperature for a first duration. The upgraded carbon fiber can comprise a carbonized matrix formed by merged carbon fibrils of the porous scaffold, and carbon black particles embedded within the carbonized matrix.

In one or more embodiments, a method can comprise subjecting organic compounds in a gaseous state within an enclosure to a first temperature, such that at least some of the organic compounds undergo pyrolysis to form carbon and hydrogen. The method can further comprise capturing at least some of the formed carbon on, within, or both on and within a first material portion. The first material portion can be disposed within the enclosure and can be composed of carbon. The method can also comprise separating the formed hydrogen from remaining organic compounds.

Any of the various innovations of this disclosure can be used in combination or separately. This summary is provided to introduce a selection of concepts in a simplified form that are further described below in the detailed description. This summary is not intended to identify key features or essential features of the claimed subject matter, nor is it intended to be used to limit the scope of the claimed subject matter. The foregoing and other objects, features, and advantages of the disclosed technology will become more apparent from the following detailed description, which proceeds with reference to the accompanying figures.

BRIEF DESCRIPTION OF THE DRAWINGS

Embodiments will hereinafter be described with reference to the accompanying drawings, which have not necessarily been drawn to scale. Where applicable, some elements may be simplified or otherwise not illustrated in order to assist in the illustration and description of underlying features. Throughout the figures, like reference numerals denote like elements.

DETAILED DESCRIPTION

General Considerations

Figure 1A:
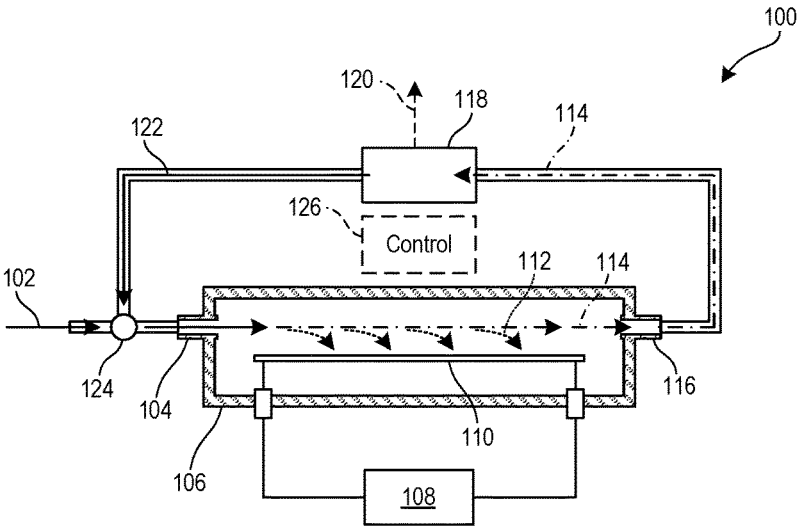
FIG. 1A is a simplified schematic diagram of an organic compound pyrolysis system employing a carbon material as a Joule heating element and for carbon capture, according to one or more embodiments of the disclosed subject matter.

For purposes of this description, certain aspects, advantages, and novel features of the embodiments of this disclosure are described herein. The disclosed methods and systems should not be construed as being limiting in any way. Instead, the present disclosure is directed toward all novel and nonobvious features and aspects of the various disclosed embodiments, alone and in various combinations and subcombinations with one another. The methods and systems are not limited to any specific aspect or feature or combination thereof, nor do the disclosed embodiments require that any one or more specific advantages be present, or problems be solved. The technologies from any embodiment or example can be combined with the technologies described in any one or more of the other embodiments or examples. In view of the many possible embodiments to which the principles of the disclosed technology may be applied, it should be recognized that the illustrated embodiments are exemplary only and should not be taken as limiting the scope of the disclosed technology.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods. Additionally, the description sometimes uses terms like "provide" or "achieve" to describe the disclosed methods. These terms are high-level abstractions of the actual operations that are performed. The actual operations that correspond to these terms may vary depending on the particular implementation and are readily discernible by one skilled in the art.

The disclosure of numerical ranges should be understood as referring to each discrete point within the range, inclusive of endpoints, unless otherwise noted. Unless otherwise indicated, all numbers expressing quantities of components, molecular weights, percentages, temperatures, times, and so forth, as used in the specification or claims are to be understood as being modified by the term "about." Accordingly, unless otherwise implicitly or explicitly indicated, or unless the context is properly understood by a person skilled in the art to have a more definitive construction, the numerical parameters set forth are approximations that may depend on the desired properties sought and/or limits of detection under standard test conditions/methods, as known to those skilled in the art. When directly and explicitly distinguishing embodiments from discussed prior art, the embodiment numbers are not approximates unless the word "about" is recited. Whenever "substantially," "approximately," "about," or similar language is explicitly used in combination with a specific value, variations up to and including 10% of that value are intended, unless explicitly stated otherwise.

Directions and other relative references may be used to facilitate discussion of the drawings and principles herein but are not intended to be limiting. For example, certain terms may be used such as "inner," "outer,", "upper," "lower," "top," "bottom," "interior," "exterior," "left," right," "front," "back," "rear," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" part can become a "lower" part simply by turning the object over. Nevertheless, it is still the same part, and the object remains the same.

As used herein, "comprising" means "including," and the singular forms "a" or "an" or "the" include plural references unless the context clearly dictates otherwise. The term "or" refers to a single element of stated alternative elements or a combination of two or more elements unless the context clearly indicates otherwise.

Although there are alternatives for various components, parameters, operating conditions, etc. set forth herein, that does not mean that those alternatives are necessarily equivalent and/or perform equally well. Nor does it mean that the alternatives are listed in a preferred order, unless stated otherwise. Unless stated otherwise, any of the groups defined below can be substituted or unsubstituted.

Unless explained otherwise, all technical and scientific terms used herein have the same meaning as commonly understood to one skilled in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Features of the presently disclosed subject matter will be apparent from the following detailed description and the appended claims.

Overview of Terms

The following is provided to facilitate the description of various aspects of the disclosed subject matter and to guide those skilled in the art in the practice of the disclosed subject matter. Inert gas: A gas that does not undergo a chemical reaction when subjected to the particular temperature of a corresponding stage (e.g., 1200 K to 2773 K). In some embodiments, the inert gas is nitrogen, argon, helium, neon, krypton, xenon, radon, oganesson, or any combination of the foregoing.

Organic Compound: A chemical compound containing carbon-hydrogen bonds. In some embodiments, the organic compound is provided in its gaseous stage for conversion via pyrolysis. For example, the organic compound can be a hydrocarbon gas, such as but not limited to methane ($CH_4$), acetylene ($C_2H_2$), ethylene ($C_2H_4$), ethane ($C_2H_6$), propane ($C_3H_8$), propylene ($C_3H_6$), methylacetylene ($C_3H_4$), butane ($C_4H_{10}$), butylene ($C_4H_6$), butyne ($C_4H_6$), pentane ($C_5H_{12}$), pentene ($C_5H_{10}$), pentyne ($C_5H_8$), isoprene ($C_5H_8$), hexane ($C_6H_{14}$), hexene ($C_6H_{12}$), hexyne ($C_6H_{10}$), benzene ($C_6H_6$), heptane ($C_7H_{16}$), heptene ($C_7H_{14}$), heptyne ($C_7H_{12}$), toluene ($C_7H_8$), octane ($C_8H_{18}$), octene ($C_8H_{16}$), octyne ($C_8H_{14}$), nonane ($C_9H_{20}$), nonene ($C_9H_{18}$), nonyne ($C_9H_{16}$), decane ($C_{10}H_{22}$), decene ($C_{10}H_{20}$), decyne ($C_{10}H_{18}$), naphthalene ($C_{10}H_8$), undecane ($C_{11}H_{24}$), dodecane ($C_{12}H_{26}$), variations (e.g., cycloalkanes, alkadienes, etc.) of any of the foregoing, or combinations of any of the foregoing.

Conversion (%): The percentage of an initial batch of methane (or other organic compound) converted into products (e.g., via pyrolysis), based on the detected amount of unreacted methane (or other organic compound) in an outlet of a processing enclosure (e.g., furnace). For example, the conversion percentage can be determined according to Eqn. 1:

$$\%\ \text{Conversion}_{CH_4} = \left(1 - \frac{n_{CH_4,unreacted}}{n_{CH_4,feed}}\right) \times 100, \tag{1}$$

where $\eta_{CH_4,unreacted}$ is the detected quantity (e.g., via a thermal conductivity detector and/or a gas chromatography system) of unreacted methane in the outlet, and $\eta_{CH_4,feed}$ is the initial quantity of methane provided to the inlet.

Hydrogen Selectivity (%): The percentage of products from conversion (e.g., pyrolysis) of methane (or other organic compound) that constitute hydrogen gas, calculated on a hydrogen atom basis, based on the detected amounts of unreacted methane (or other organic compound) and hydrogen in an outlet of a processing enclosure (e.g., furnace). For example, the selectivity can be determined according to Eqn. 2:

$$\%\ \text{Hydrogen Selectivity} = \frac{n_{H_2}}{2 \times \left(n_{CH_4,feed} - n_{CH_4,unreacted}\right)} \times 100, \tag{2}$$

where $\eta_{H_2}$ is the detected quantity (e.g., via a thermal conductivity detector and/or a gas chromatography system) of hydrogen gas in the outlet, $\eta_{CH_4,unreacted}$ is the detected quantity of unreacted methane in the outlet, and $\eta_{CH_4,feed}$ is the initial quantity of methane provided to the inlet.

Hydrogen Gas Yield (%): Hydrogen gas generated by conversion (e.g., pyrolysis) of methane (or other organic compound) versus the amount of hydrogen gas otherwise available for release from an initial quantity of methane (or other organic compound). For example, the yield can be determined according to Eqn. 3:

$$\%\ \text{Hydrogen Yield} = \frac{n_{H_2}}{2 \times n_{CH_4,feed}} \times 100, \tag{3}$$

where $\eta_{H_2}$ is the detected quantity (e.g., via a thermal conductivity detector and/or a gas chromatography system) of hydrogen gas in the outlet, and $\eta_{CH_4,feed}$ is the initial quantity of methane provided to the inlet.

Introduction

Embodiments of the disclosed subject matter provide catalyst-free pyrolysis of one or more organic compounds (e.g., methane) in a gas state into carbon particles and hydrogen gas, where an expendable porous carbon material (or portion thereof) is used to capture at least some of the produced carbon particles, thereby avoiding $CO_2$ emissions. In some embodiments, the carbon particles are deposited on and/or within the porous carbon material, thereby reducing the porosity of the carbon material as well as improving the mechanical and/or electrical properties of the carbon material. In some embodiments, the carbon material can be used as a Joule heating element, where an electrical current passed through the carbon material generates the high temperature (e.g., 1200-1800 K, inclusive) that drives the pyrolysis of the organic compound(s).

In some embodiments, the carbon material can comprise one or more carbon fibers (e.g., having a diameter, or a maximum cross-sectional dimension, ≤100 μm, for example, ≤25 μm). Prior to use in pyrolysis of the organic compound(s), the carbon fibers can be formed as low-quality carbon fibers, for example, incorporating carbon black particles (e.g., having a diameter, or a maximum cross-sectional dimension, ≤1 μm, for example, 20-200 nm, inclusive) into a porous scaffold formed by carbon fibrils (e.g., nanofibers having a diameter, or a maximum cross-sectional dimension, ≤200 nm, for example, ≤100 nm) and having reduced mechanical properties (e.g., tensile strength≤100 MPa) and/or electrical properties (e.g., conductivity≤10+S/m). In some embodiments, use of the carbon fiber as a Joule heating element can render localized high temperatures, for example, at mechanically weak points (e.g., defective sites) within the fiber, which can lead to spatially selective carbon deposition. The deposited carbon species can adhere to the adjacent carbon black particles within the carbon fiber, fill the pores, and heal the defects therein, thereby densifying the fiber microstructure.

In some embodiments, the heating of the carbon fibers can involve a higher temperature heating prior to the organic compound pyrolysis (e.g., a graphitization stage, at a temperature of 2000-2773 K for ≤5 minutes in an inert gas) and/or a higher temperature heating after the organic compound pyrolysis (e.g., a further graphitization stage, at a temperature of 2000-2773 K for ≤5 minutes in an inert gas), which may serve to improve the crystallization of the deposited carbon within the carbon fibers. Alternatively or additionally, the high temperature graphitization stages can further adhere the carbon black particles (e.g., by strengthening the carbon bonding with more $sp^2$ carbon) and densify the fiber microstructure. After such treatments, the carbon fibers can be considered high-quality, for example, having improved mechanical properties (e.g., a tensile strength at least 5-10× greater, such as ~1.2 GPa; a tensile modulus such as ~120 GPa) and/or improved electrical properties (e.g., electrical conductivity at least 10-20× greater, such as ~1.5× $10^5$ S/m).

In some embodiments, the introduction of carbon black (e.g., up to 80 wt %) produced from organic compound pyrolysis into the carbon fibers can significantly reduce their associated production cost, for example, less than half as expensive as conventional carbon fibers produced from 100% polyacrylonitrile (PAN). In addition to upgrading low-quality carbon fibers, the organic compound pyrolysis can also yield high-purity hydrogen gas ($H_2$) production, with an $H_2$ selectivity of ~90% and without requiring a separate catalyst. By avoiding the use of a catalyst, embodiments of the disclosed subject matter eliminate the need for catalyst/carbon separation and benefit from reduced operation costs. When powered using renewable energy sources, embodiments of the disclosed subject matter can have zero (or substantially zero) $CO_2$ footprint, thus offering a green and carbon-neutral platform for $H_2$ generation and high-quality carbon fiber synthesis.

Referring to FIG. 1A, a system 100 for pyrolysis of one or more organic compounds is shown. The system 100 can have a gas enclosure 106 (e.g., a furnace or reactor) that comprises and/or defines an internal volume, one or more inlets 104 to the internal volume, and one or more outlets 116 from the internal volume. An inlet feed 102 can provide a batch (e.g., as a fixed volume, continuously, or substantially continuously) of organic compound(s) (e.g., methane or natural gas) in a gaseous state to the enclosure inlet 104 via feed coupler 124.

Figure 1B:
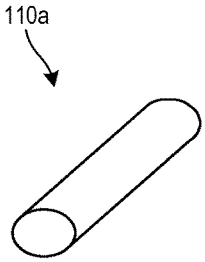
FIGS. 1B-1D illustrate exemplary configurations for a carbon material, according to one or more embodiments of the disclosed subject matter.
Figure 1C:
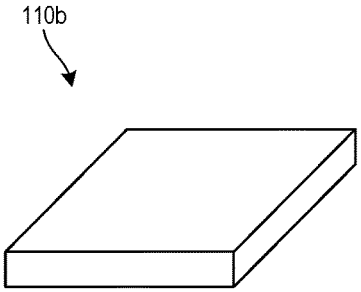
Figure 1D:
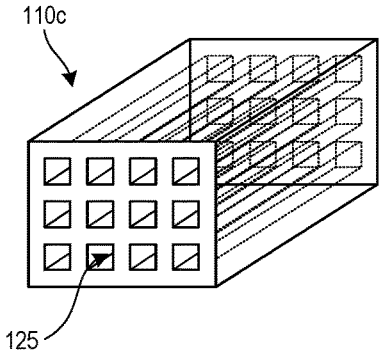

The system 100 can also have a current source 108 electrically coupled to a carbon material 110 within the internal volume by a pair of electrodes, such that the carbon material 110 can serve as a Joule heating element for generating the high temperatures that drive pyrolysis of organic compounds within the gas enclosure 106. As described above, the carbon material 110 can comprise a porous scaffold of carbon fibrils. In some embodiments, the carbon material 110 can further comprise carbon black particles attached to the carbon fibrils. For example, in some embodiments, the carbon material 110 can be formed as a substantially 1-D structure (e.g., fiber 110*a* in FIG. 1B), 2-D structure (e.g., plate 110*b* in FIG. 1C), or 3-D structure (e.g., block 110*c* in FIG. 1D, which may optionally include artificial or natural pores or channels 125 to allow gases to more readily interact with interior portions of the block 110*c*).

In operation, an electrical current from current source 108 can be passed through the carbon material 110 to cause Joule heating thereof and to thereby subject the carbon material 110 and/or the organic compound(s) within the gas enclosure 106 to a high temperature (e.g., a first temperature), for example, a temperature in a range of 1200-1800 K, inclusive. The high temperature can cause pyrolysis of the organic compound(s) within the gas enclosure 106 (or at least flowing adjacent to or through the carbon material 110), thereby decomposing into carbon particles 112 (e.g., carbon black) and hydrogen gas. The formed carbon particles become deposited on and/or within the carbon material 110, while the hydrogen gas is carried with any unreacted organic compound(s) (or any other unreacted gas in the enclosure, such as an inert gas) as an outlet flow stream 114. In particular, the carbon derived from the decomposition of the organic compound(s) can decrease the porosity of the carbon material 110, for example, by filling any gaps or voids therein (e.g., between carbon particles and PAN-based carbon fibrils of an original low-quality carbon fiber, as described in further detail hereinbelow).

The outlet flow stream 114 (e.g., a mixture of unreacted organic compound(s) and released hydrogen gas) flowing through the outlet 116 of the enclosure 106 can be redirected back to the inlet 104 via a feed coupler 124. Prior to reaching the coupler 124, the outlet stream 114 can be further processed by hydrogen separator 118, for example, to remove or isolate a stream 120 of hydrogen gas from a stream 122 of unreacted organic compounds in the outlet gases. For example, the hydrogen separator 118 can employ a proton exchange membrane, which allows protonic/electronic transport between the first and second gas volumes, such that $H_2$ produced from prior methane conversion can be permeated through the membrane in order to isolate it from other gases in stream 114. In some embodiments, the hydrogen separator 118 can comprise the proton exchange membrane on a porous support. For example, the support can be formed of a perovskite-type oxide having a formula of $M'Ce_{1-z}Zr_zO_{3-\delta}$, where M' is Sr or Ba, and z is between 0.01 and 0.3, inclusive, and the membrane can be formed of a perovskite-type oxide having a formula of $$M'Ce_{1-x-y}Zr_xM''_yO_{3-\delta},$$

where M' is a least one of Sr and Ba; M" is at least one of Ti, V, Cr, Mn, Fe, Co Ni, Cu, Nb, Mo, W, Pr, Nd, Pm, Sm, Eu, Gd, Tb, Dy, Ho, Er, Tm and Yb; x is between 0.01 and 0.2, inclusive; and y is between 0.01 and 0.3, inclusive. Other suitable materials and configurations for a permeable membrane and/or porous support that can be used for hydrogen separation are disclosed in, for example, U.S. Pat. No. 10,525,407, entitled "Systems, Methods, and Devices for Direct Conversion of Methane," which membrane and support constructions are incorporated herein by reference.

After hydrogen separation, the resulting stream 122 (e.g., comprising unreacted organic compound(s)) can proceed to the feed coupler 124, which can combine the stream 122 with fresh organic compounds from inlet feed 102 for reprocessing. Alternatively or additionally, in some embodiments, the feed coupler 124 can select between the stream 122 and the inlet feed 102 for provision to inlet 104.

System 100 can further include a controller 126 operatively coupled to one, some, or all of the illustrated components and configured to control operation thereof. For example, the controller 126 can modify flow rates, feed gas composition, and/or current for Joule heating, to regulate pyrolysis efficiency and/or product selectivity. Gas flow lines within system 100 can include respective gas flow control and one or more sensing modules, which may include, for example, valves, temperature sensors, temperature controllers, pumps, mass flow controllers, and/or other devices to monitor and/or control the variables of gas flow rates and/or reaction temperatures. In some embodiments, the controller 126 can also control operation of components not illustrated, such as pumps, valves, switches, translation devices, etc., to effect flow of fluid (e.g., single gases or gas mixtures) and/or movement of carbon materials (e.g., when carbon material 110, operating as a Joule heating element, is expended or full) into, within, and/or out of the system.

In the illustrated example of FIG. 1A, the carbon material 110 is directly Joule heated by passing an electrical current therethrough. Such direct heating of the carbon material 110 can allow for better control of the resulting temperature and/or temperature profile (e.g., to allow for rapid temperature ramping). Moreover, the direct heating of the carbon material 110 can avoid excessive energy loss during heat transfer, at least as compared to conventional radiative heating setups where the heater is spaced from the carbon material 110. However, in some embodiments, a heating element (e.g., Joule heating or another heating modality, such as a microwave heating source, a laser, an electron beam device, or a spark discharge device) can be provided separate from the carbon material.

Figure 1E:
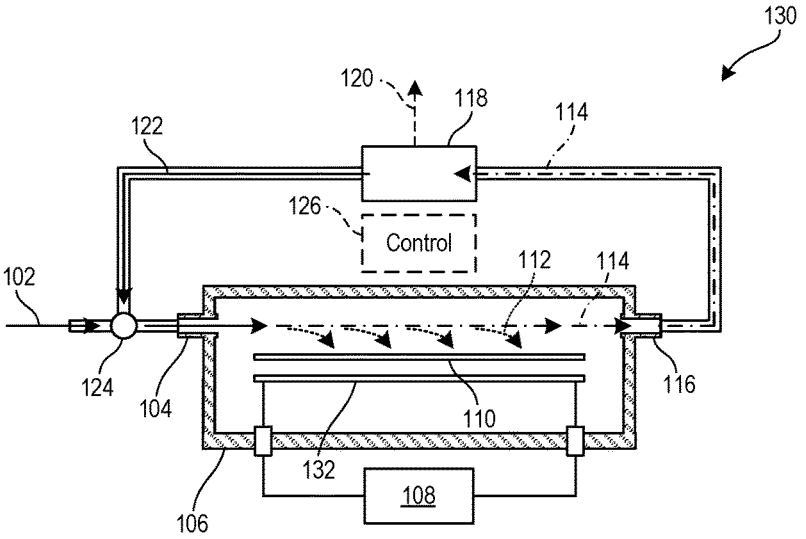
FIG. 1E is a simplified schematic diagram of another system employing a carbon material for carbon capture and a separate heating element, according to one or more embodiments of the disclosed subject matter.

For example, FIG. 1E shows a system 130 similar to system 100 of FIG. 1A, but where a Joule heating element 132 is provided separate from and in thermal communication with carbon material 110. Similar to FIG. 1A, electrical current from current source 108 can be passed through heating element 132, to cause Joule heating thereof and to thereby subject the carbon material 110 and/or the organic compound(s) within the gas enclosure 106 to a high temperature (e.g., 1200-1800 K, inclusive) in order to drive pyrolysis of organic compound(s) within the enclosure 106. Although shown spaced from the carbon material 110 in FIG. 1E, in some embodiments, the Joule heating element 132 may be in direct contact or indirect contact (e.g., with one or more solid structures therebetween) with carbon material 110.

For example, the Joule heating element 132 can be similar to any of the heating elements disclosed in U.S. Publication No. 2018/0369771, entitled "Nanoparticles and systems and methods for synthesizing nanoparticles through thermal shock," U.S. Publication No. 2019/0161840, entitled "Thermal shock synthesis of multielement nanoparticles," International Publication No. WO 2020/236767, entitled "High temperature sintering systems and methods," and International Publication No. WO 2020/252435, entitled "Systems and methods for high temperature synthesis of single atom dispersions and multi-atom dispersions," which disclosed heating elements are incorporated herein by reference.

In the illustrated example of FIG. 1A, the carbon material 110 is provided in a static configuration within the enclosure 106. However, as carbon is deposited from pyrolysis of the organic compound(s) on and/or within the carbon material 110, it may be necessary to replace the carbon material 110, for example, when deposition efficiency is reduced due to achieving sufficiently low porosity, when the carbon material 110 has achieved a desired state (e.g., when the carbon material is being upgraded to a high quality material, such as a carbon fiber), or for any other reason. In some embodiments, instead of (or in addition to) replacing the entire carbon material 110, individual portions of a continuous carbon material 110 can be provided within the enclosure at different times to serve as the Joule heating element.

Figure 1F:
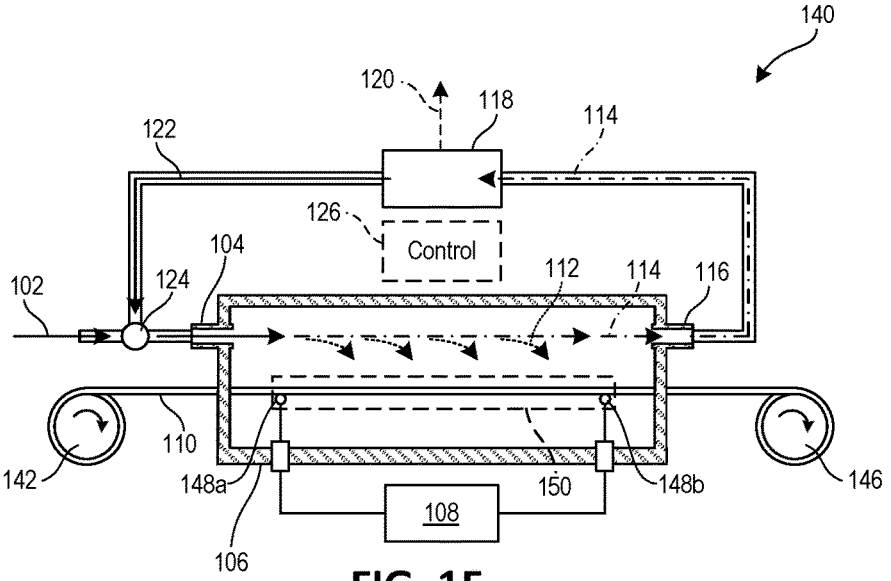
FIG. 1F is a simplified schematic diagram of another system employing a continuous carbon material as a Joule element and for carbon capture, according to one or more embodiments of the disclosed subject matter.

For example, FIG. 1F shows another system 140 similar to system 100 of FIG. 1A, but where the carbon material 110 is a continuous structure (e.g., fiber) that extends between a supply roller 142 and a product roller 146. A pair of conductive rollers 148*a*, 148*b* provide electrical contact to the portion of carbon material 110 within the enclosure 106, while still allowing the portion of the carbon material 110 to be moved and/or changed. Similar to FIG. 1A, electrical current from current source 108 can be passed through portion 150 of carbon material 110 to cause Joule heating thereof and to thereby subject the portion 150 and/or the organic compound(s) within the gas enclosure 106 to a high temperature (e.g., 1200-1800 K, inclusive) in order to drive pyrolysis of organic compound(s) within the enclosure 106.

In some embodiments, the carbon material 110 can be substantially static during operation. For example, a first portion of the carbon material 110 may be maintained at a fixed position within enclosure 106 (e.g., without rotation of rollers 142, 146, 148*a*, and 148*b*) until the carbon material 110 has been expended or until a predetermined time period has elapsed (e.g., 20 minutes for carbon fiber upgrading). The roller 142, 146 can then be actuated to increment the carbon material 110 to move the first portion out of the enclosure 106 and to position a next portion within the enclosure 106 for subsequent use as the Joule heating element. Alternatively, in some embodiments, the carbon material 110 can move during some or all of the operation. For example, rollers 142, 146 can be actuated to move the carbon material 110 at a substantially constant speed through the enclosure 106, such that a transit time of each portion of the carbon material 110 through the enclosure corresponds with a time period for exhaustion and/or a predetermined time period (e.g., for fiber upgrading).

Low Quality and Upgraded Carbon Fibers

In some embodiments, the carbon material is carbon fiber. Moreover, in some embodiments, the carbon deposition resulting from pyrolysis of organic compound(s) can be used to upgrade (e.g., enhance mechanical and/or electrical properties) a low-quality carbon fiber into a high-quality carbon fiber. For example, the low-quality carbon fiber can incorporate carbon black particles during the spinning process of fiber precursors, which incorporation can reduce the material and/or fabrication costs associated with producing a high-quality carbon fiber.

Figure 2A:
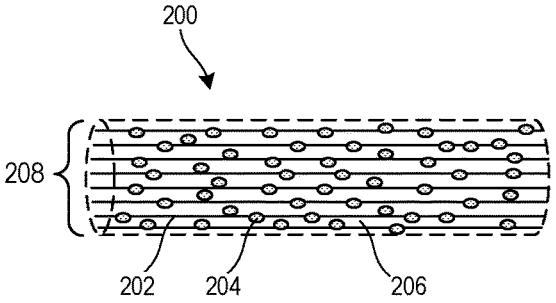
FIGS. 2A-2B are simplified diagrams illustrating side and cross-sectional views, respectively, of a low-quality carbon fiber for upgrading via organic compound pyrolysis, according to one or more embodiments of the disclosed subject matter.
Figure 2B:
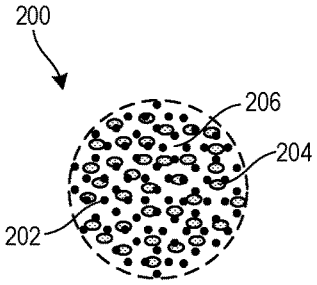

For example, carbon black particles can be mixed with a polymer, such as polyacrylonitrile (PAN), and spun into a precursor filament, for example, via dry-jet wet spinning or blow spinning. The precursor filament can then be heated in a furnace (e.g., stabilization at 593 K for 20 minutes in air followed by carbonization at 1588 K for 10 minutes in nitrogen) to produce low-quality carbon fiber. As shown in FIGS. 2A-2B, the low-quality carbon fiber 200 can be formed by a plurality of PAN-induced carbon fibrils 202 (e.g., nanofibers having a diameter, or maximum cross-sectional dimension, of ≤100 nm) substantially aligned with each other to form a porous scaffold 208. A plurality of carbon black particles 204 are embedded and/or attached to the carbon fibrils 202. The fibers 200 exhibit an aligned nanofiber network and porous structure, e.g., with pores or voids 206 evident in the fiber cross-section.

Figure 2C:
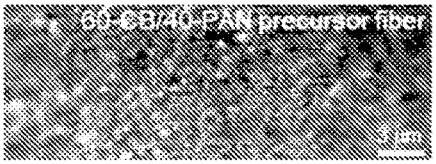
FIGS. 2C-2D are scanning electron microscopy (SEM) and scanning transmission electron microscopy (STEM) images, respectively, of an as-spun precursor fiber formed of 60% carbon black and 40% PAN, according to one or more embodiments of the disclosed subject matter.
Figure 2D:
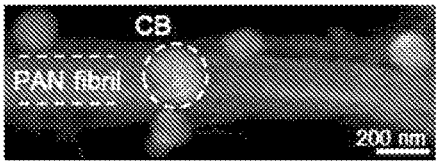
Figure 2E:
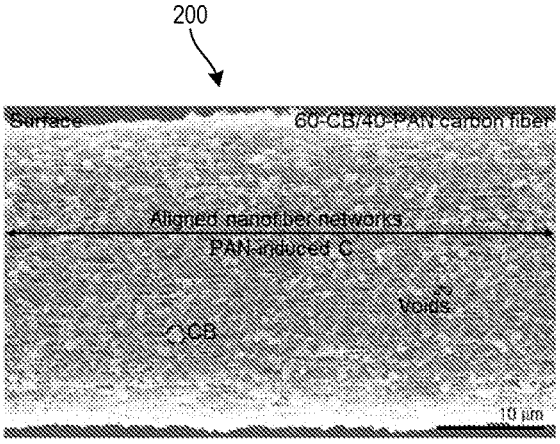
FIGS. 2E-2F are SEM images illustrating surface and cross-sectional morphologies, respectively, of a carbon fiber formed of 60% carbon black and 40% PAN prior to upgrading via organic compound pyrolysis, according to one or more embodiments of the disclosed subject matter.
Figure 2F:
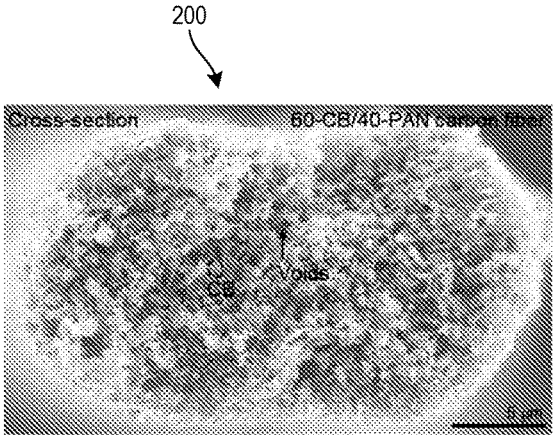

FIGS. 2E-2F show the surface and cross-sectional morphologies of a 60-CB/40-PAN carbon fibers (i.e., 60 wt % carbon black and 40 wt % PAN-induced carbon fibrils). Lower carbon black (CB) loadings can lead to smaller fiber diameters and lower void fractions. For example, the 60-CB/40-PAN carbon fiber shows a diameter of 23.4±0.6 μm and a void fraction of 26.9±1.0%, while the 20-CB/80-PAN carbon fiber exhibits a diameter of 12.1±0.6 μm and a void fraction of 15.8±1.4%. The porous nature of the CB/PAN carbon fibers causes the mechanical properties and/or electrical properties to be lower as compared to the properties of pure PAN-based carbon fibers.

Figure 3A:
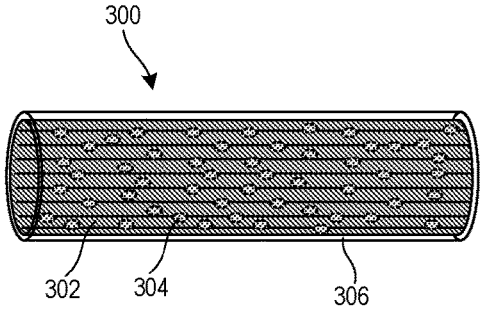
FIGS. 3A-3B are simplified diagrams illustrating side and cross-sectional views, respectively, of a high-quality carbon fiber after upgrading via organic compound pyrolysis, according to one or more embodiments of the disclosed subject matter.
Figure 3B:
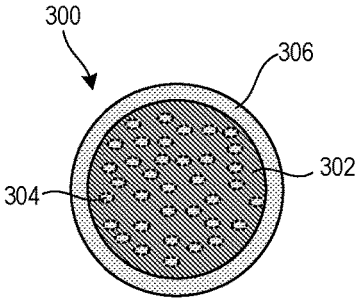

The low-quality carbon fibers 200 can be used as an in-situ Joule heating substrate in the presence of an organic compound, such as methane, to drive pyrolysis thereof (e.g., by heating at 1700 K for 20 minutes). After electrically heating the fibers to conduct the pyrolysis reaction, carbon derived from the decomposition of the organic compound(s) fills the gaps or voids 206 between the CB particles 204 and the PAN-based carbon fibrils 202, thereby forming a high-quality carbon fiber 300 as shown in FIGS. 3A-3B. In particular, the carbon fibrils 202 of the low-quality carbon fiber 200 can merge to form a carbonized matrix 302, while the CB particles 304 from the low-quality carbon fiber 200 become embedded within the carbonized matrix 302. In some embodiments, some of the CB particles from the low-quality carbon fiber 200 can aggregate (e.g., enlarge and/or connect together) to form larger CB particles. The pyrolysis-derived carbon can further form a surface-deposited carbon layer 306 that increases a diameter of the high-quality fiber 300 as compared to the low-quality fiber 200. As shown in FIGS. 3C-3F, an upgraded 60-CB/40-PAN carbon fiber has a denser structure than the low-quality carbon fiber of FIGS. 2E-2F. The decreased porosity and increased density afforded by the integration of pyrolysis-derived carbon can improve the mechanical properties and/or electrical properties of the carbon fiber. For example, the upgraded CB/PAN carbon fibers 300 can exhibit a high tensile strength (e.g., ~1.2 GPa), high tensile modulus (e.g., ~120 GPa), and high electrical conductivity (e.g., $\sim 1.5\times10^5$ S/m).

Although much of the discussion herein focuses on the use of PAN for carbon fiber formation, embodiments of the disclosed subject matter are not limited thereto. Rather, any of various polymers can be used as the polymer matrix to subsequently form carbon fibers. For example, low-quality carbon fibers can be formed from rayon, lignin, or pitch. Similarly, although methane-derived carbon black particles have been described herein, other carbon black particle configurations are also possible according to one or more contemplated embodiments. For example, carbon black particles having different particle sizes, functional modifications, etc. can be used for forming the low-quality carbon fibers.

Methods for Organic Compound Pyrolysis

Figure 4:
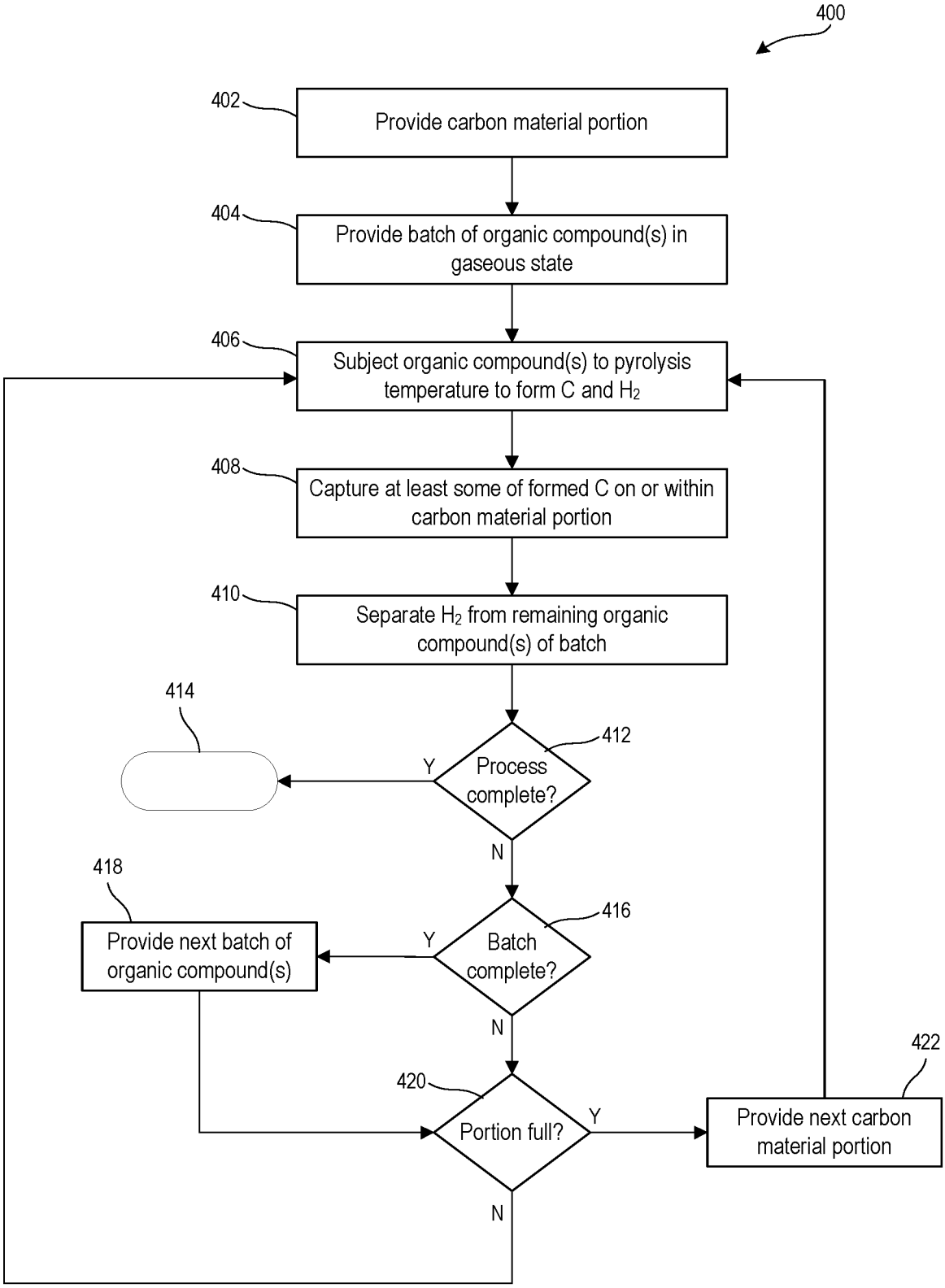
FIG. 4 is a process flow diagram of a method for catalyst-free pyrolysis of organic compound(s) using a carbon material for carbon capture, according to one or more embodiments of the disclosed subject matter.
Figure 13A:
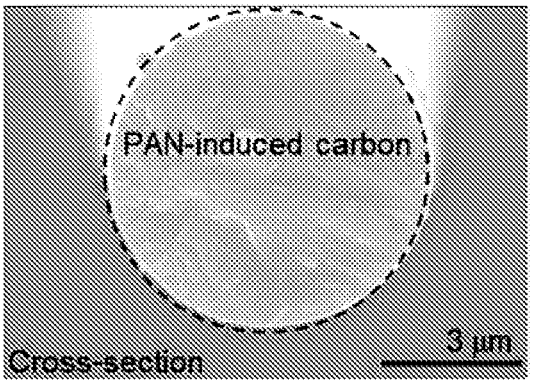
FIGS. 13A-13B are SEM images of the cross-sectional morphology of a PAN carbon fiber before and after upgrading.

FIG. 4 illustrates a method 400 for catalyst-free pyrolysis of organic compound(s) using a carbon material for carbon capture. The method 400 can initiate at process block 402, where a carbon material, or a portion thereof, can be provided for carbon capture. For example, in some embodiments, the carbon material can be provided within a gas enclosure and electrically connected to a current source for use of the carbon material to provide Joule heating. In some embodiments, the carbon material can have a porous scaffold of carbon fibrils. For example, the carbon material can be a low-quality porous carbon fiber (e.g., comprising embedded CB particles). In some embodiments, the provision of process block 402 can include forming the carbon material, for example, by spinning a precursor filament, subjecting the filament to a stabilization treatment, and subjecting the filament to a carbonization treatment to form a low-quality porous carbon fiber. Alternatively, in some embodiments, the provision of process block 402 can include providing a commercial off-the-shelf carbon material, such as a 100% PAN-based carbon fiber (e.g., as described with respect to FIGS. 13A-13B hereinbelow).

The method 400 can proceed to process block 404, where a batch of organic compound(s) in a gaseous state can be provided. In some embodiments, the provided batch can be a fixed volume flowed into the gas enclosure for processing. Alternatively, in some embodiments, the provision of a batch can be via a continuous or semi-continuous flow of organic compound(s) through the gas enclosure. For example, organic compound(s) can be provided at a flow rate of 3 sccm. In such configurations, only a portion of the organic compound(s) batch flowing through the gas enclosure at any particular time may be subject to processing.

The method 400 can proceed to process block 406, where the organic compound(s) within the gas enclosure are subjected to a high temperature (e.g., 1200-1800 K) to cause pyrolysis of the organic compound(s) into carbon particles and hydrogen gas. In some embodiments, the carbon material within the gas enclosure is used as a Joule heating element to heat and maintain the high temperature during pyrolysis. Alternatively or additionally, a separate Joule heating element or another heating modality (e.g., microwave, laser, spark discharge, etc.) can be provided to heat and/or maintain the high temperature during process block 406.

The method 400 can proceed to process block 408, where at least some of the carbon particles are captured by the portion of the carbon material within the gas enclosure. For example, when used as the Joule heating element, localized high temperatures at mechanically weak points (e.g., defect sites) can lead to spatially selective carbon deposition at such locations. Alternatively or additionally, the carbon derived from the decomposition of the organic compound(s) can fill voids in the carbon material portion, thereby decreasing its porosity. For example, the carbon fibrils of the material portion can merge to form a carbonized matrix, and CB particles previously therein become embedded within the carbonized matrix (and optionally enlarge and/or aggregate). In some embodiments, the carbon capture of process block 408 can further involve formation of a surface-deposited carbon layer on the carbon material portion.

The method 400 can proceed to process block 410, where hydrogen gas is separated or isolated from unreacted organic compound(s) and/or other gases from the gas enclosure. For example, the hydrogen separation of process block 410 can employ a proton exchange membrane, as described above. In some embodiments, the separation of process block 410 can further include storage of the separated hydrogen, for example, by storing the hydrogen gas in high-pressure tanks as a compressed gas.

The method 400 can proceed to decision block 412, where it is determined if the process should terminate, for example, if no further processing is desired, for system maintenance, or for any other purpose. If termination is desired, the method 400 can proceed to terminal 414. Otherwise, the method 400 can proceed to decision block 416, where it is determined if processing of the batch of organic compound(s) has been completed, for example, such that at least 90% of methane in the original feed has been converted to carbon particles and hydrogen gas. If batch processing has been completed, the method 400 can proceed to process block 418, where the next batch of organic compound(s) can be introduced to the gas enclosure. Alternatively, a feed of fresh organic compound(s) can be combined with an unprocessed part of the batch and/or a recycled feed of unreacted organic compound(s) so as to operate on a continuous or semi-continuous basis.

Otherwise, the method 400 can proceed to decision block 420, where it is determined if the carbon material portion within the gas enclosure has been expended, for example, due to a sufficient reduction in porosity, due to deposition of a surface layer that inhibits further deposition, and/or due to passage of a predetermined time corresponding to desired properties of a material upgrade (e.g., 20 minutes at 1700 K). If the carbon material portion has not been expended, the method 400 can proceed from decision block 420 to process block 406 for continuance of the pyrolysis, carbon capture, and hydrogen gas separation. If the carbon material portion has been expended, the method 400 can proceed to process block 422, where a fresh portion of the carbon material (or a new carbon material) is provided. For example, the provision of process block 422 can involve translating a continuous carbon material through the gas enclosure such that the expended portion of the carbon material is removed from the gas enclosure and a fresh portion of the carbon material is disposed within the gas enclosure. The method 400 can then return to process block 406 for continuance of the pyrolysis, carbon capture, and hydrogen gas separation using the fresh carbon material portion.

Although illustrated separately, it is contemplated that various process blocks may occur simultaneously or iteratively. For example, the organic compound providing of process block 404, pyrolysis of process block 406, carbon capture of process block 408, and/or hydrogen separation of process block 410 can occur simultaneously despite being illustrated as sequential process blocks. Furthermore, certain process blocks illustrated as occurring after others may indeed occur before. Although some of blocks 402-422 of method 400 have been described as being performed once, in some embodiments, multiple repetitions of a particular process block may be employed before proceeding to the next decision block or process block. In addition, although blocks 402-422 of method 400 have been separately illustrated and described, in some embodiments, process blocks may be combined and performed together (simultaneously or sequentially). Moreover, although FIG. 4 illustrates a particular order for blocks 402-422, embodiments of the disclosed subject matter are not limited thereto. Indeed, in certain embodiments, the blocks may occur in a different order than illustrated or simultaneously with other blocks.

Methods for Carbon Fiber Upgrade

Figure 5A:
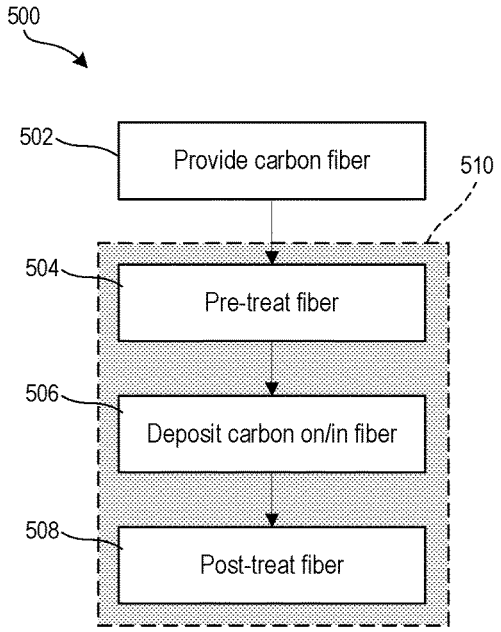
FIG. 5A is a process flow diagram of a method for upgrading a carbon fiber via organic compound pyrolysis, according to one or more embodiments of the disclosed subject matter.

FIG. 5A illustrates a generalized method 500 for upgrading a carbon fiber via pyrolysis of one or more organic compound(s). The method 500 can initiate a process block 502, where a carbon fiber, or a portion thereof, can be provided. For example, in some embodiments, the carbon fiber can be provided within a gas enclosure and electrically connected to a current source for use of the carbon fiber to provide Joule heating. In some embodiments, the carbon fiber can be a low-quality porous carbon fiber (e.g., comprising embedded CB particles). In some embodiments, the provision of process block 502 can include forming the carbon fiber, for example, by spinning a precursor filament, subjecting the filament to a stabilization treatment, and subjecting the filament to a carbonization treatment to form a low-quality porous carbon fiber. Alternatively, in some embodiments, the provision of process block 502 can include providing a commercial off-the-shelf carbon fiber, such as a 100% PAN-based carbon fiber (e.g., as described with respect to FIGS. 13A-13B hereinbelow).

Figure 5B:
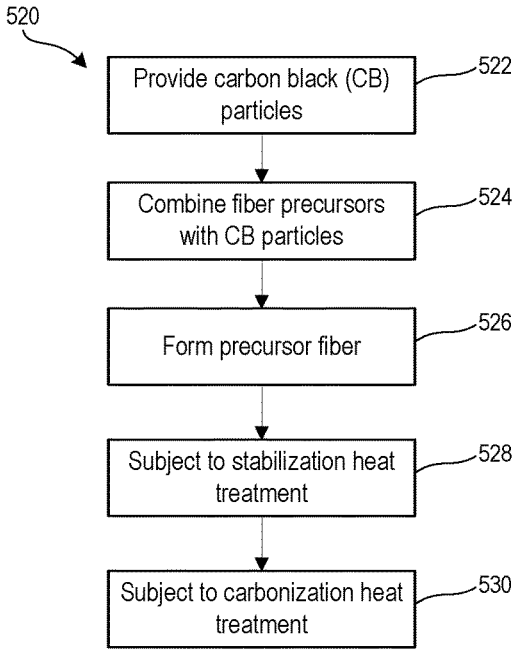
FIG. 5B is a process flow diagram of a method for forming a low-quality carbon fiber for subsequent upgrading, according to one or more embodiments of the disclosed subject matter.

For example, in some embodiments, process block 502 of FIG. 5A can include the fiber forming sub-process 520 of FIG. 5B. Sub-process 520 can initiate at process block 522, where CB particles are provided for incorporation into the precursor filament. In some embodiments, the CB particles can be obtained from a prior pyrolysis of organic compound(s) (e.g., methane pyrolysis without carbon capture). In some embodiments, the provision of process block 522 can include formation of the CB particles. The sub-process 520 can proceed to process block 524, where fiber precursors (e.g., PAN fibrils) are combined with the CB particles. For example, the CB particles and fiber precursors are mixed together in a common solution (e.g., an organic solvent, such as, but not limited to dimethyl sulfoxide (DMSO), dimethylacetamide (DMAC), or dimethylformamide (DMF)). The sub-process 520 can proceed to process block 526, where the combination of fiber precursors and CB particles is spun to form a precursor filament. For example, in some embodiments, the fiber spinning of process block 526 can comprise dry-jet wet spinning (e.g., as shown in FIG. 6B) or blow spinning.

The sub-process 520 can proceed to process block 528, where the precursor filament is subjected to a stabilization heat treatment. For example, the stabilization heat treatment may be performed in an atmosphere of air and can be effective to combine oxygen molecules from the air with the polymer fibrils of the filament (e.g., oxidation) so as to cause the polymer chains to crosslink. In some embodiments, the stabilization heat treatment may be performed at a temperature of 593 K for 20 minutes in air. The sub-process 520 can proceed to process block 530, where the stabilized precursor filament is subjected to a carbonization heat treatment. For example, the carbonization heat treatment may be performed in an atmosphere of inert gas (e.g., nitrogen) and can be effective to convert the polymer fibrils into carbon fibrils. In some embodiments, the carbonization heat treatment may be performed at a temperature of 1588 K for 10 minutes in nitrogen. The resulting low-quality carbon fiber can then be subjected to upgrading to form a high-quality carbon fiber.

Returning to FIG. 5A, the method 500 can proceed to process block 504, where a first stage of a carbon fiber upgrading process 510 can be performed. In some embodiments, process block 504 can comprise a pre-treatment of the carbon fiber, for example, a first graphitization treatment. For example, the first graphitization treatment of process block 504 can be effective to enhance crystallinity of the low-quality carbon fiber and/or strengthen bonding between the CB particles and the PAN-induced carbon of the low-quality carbon fiber.

Figure 5C:
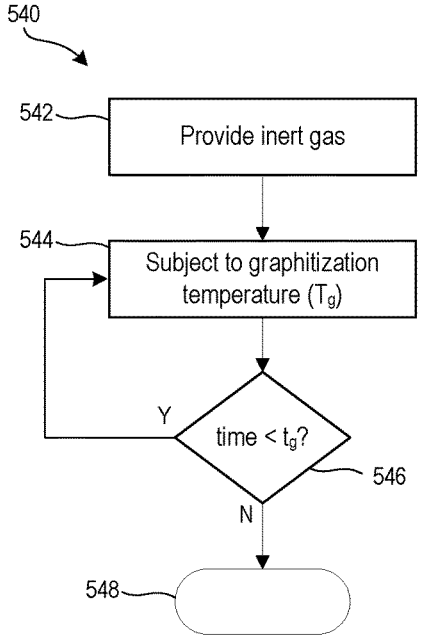
FIG. 5C is a process flow diagram of a method for pre-treatment or post-treatment graphitization of a carbon fiber, according to one or more embodiments of the disclosed subject matter.

For example, in some embodiments, process block 504 of FIG. 5A can include the graphitization sub-process 540 of FIG. 5C. Sub-process 540 can initiate at process block 542, where an inert gas is provided to a gas enclosure, which may be the same gas enclosure in which organic compound pyrolysis is later performed or a different gas enclosure (e.g., upstream of the pyrolysis enclosure). For example, the inert gas can be argon. The sub-process 540 can proceed to process block 544, where the carbon fiber is subjected to a graphitization heat treatment, which may occur at a temperature greater than the pyrolysis temperature. For example, the graphitization temperature may be in a range of 2000-2773 K, such as ~2100 K. In some embodiments, the carbon fiber can be used as a Joule heating element to generate the temperature for graphitization. The sub-process 540 can proceed to decision block 546, where it is determined if a duration of the graphitization heat treatment has been satisfied. In some embodiments, the graphitization heat treatment is continued for a duration, $t_g$, of 5 minutes or less, for example, ~2 minutes. If the duration is not yet complete, the sub-process 540 returns to process block 544 to maintain the graphitization temperature. Otherwise, if the duration is complete, the sub-process 540 can terminate at terminal 548.

Returning to FIG. 5A, the method 500 can proceed to process block 506, where a second stage of a carbon fiber upgrading process 510 can be performed. In some embodiments, process block 506 includes pyrolysis of one or more organic compounds (e.g., methane) such that carbon and hydrogen are released. The released carbon can then be deposited onto and/or within the carbon fiber. For example, the carbon deposition of process block 506 can be effective to fill gaps and voids in the carbon fiber, thereby reducing its porosity and improving mechanical and electrical properties thereof.

Figure 5D:
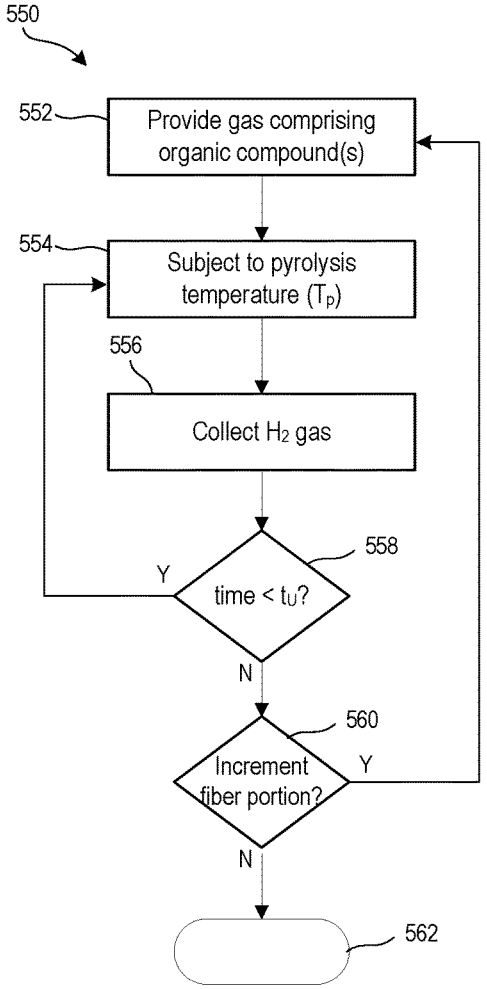
FIG. 5D is a process flow diagram of a method for organic compound pyrolysis for depositing carbon on and/or within a carbon fiber, according to one or more embodiments of the disclosed subject matter.

For example, in some embodiments, process block 506 of FIG. 5A can include the pyrolysis sub-process 550 of FIG. 5D. Sub-process 550 can initiate at process block 552, where a gas comprising one or more organic compound(s) is provided to a gas enclosure, which may be the same gas enclosure in which graphitization was previously performed or subsequently performed, or a different gas enclosure (e.g., downstream of a first graphitization enclosure). For example, the gas can comprise methane. The sub-process 550 can proceed to process block 544, where pyrolysis is performed by subjecting the organic compound(s) to a pyrolysis temperature. For example, the pyrolysis temperature may be in a range of 1200-1800 K, such as ~1700 K. In some embodiments, the carbon fiber can be used as a Joule heating element to generate the temperature for pyrolysis. The pyrolysis can be effective to decompose the organic compound(s) into carbon and hydrogen gas, and at least some of the carbon can be deposited on or within the carbon fiber.

The sub-process 550 can proceed to process block 556, where the released hydrogen gas is collected. For example, the collection of process block 556 can employ a proton exchange membrane to isolate the hydrogen gas from other components in or from the gas enclosure. The sub-process 550 can proceed to decision block 558, where it is determined if a duration of the pyrolysis heat treatment has been satisfied. In some embodiments, the pyrolysis heat treatment is continued for a duration, $t_U$, of 10-30 minutes, for example, ~20 minutes. If the duration is not yet complete, the sub-process 550 returns to process block 554 to maintain the pyrolysis temperature. Otherwise, the sub-process 550 can proceed to decision block 560, where it is determined if the carbon fiber should be translated, for example, to increment to a new fiber portion for upgrading. If increment to a new fiber portion is desired, the carbon fiber can be moved (e.g., by winding of one or more rollers), and the sub-process 550 can return to process block 552 or process block 554 for continued processing. Alternatively, in some embodiments, the carbon fiber can be moved on a continuous or semi-continuous basis, for example, such that a transit time of each portion through the gas enclosure (and/or operation as a Joule heating element) corresponds to the desired duration, $t_U$. Otherwise, if the duration is complete, the sub-process 550 can terminate at terminal 562.

Returning to FIG. 5A, the method 500 can proceed to process block 508, where a third stage of a carbon fiber upgrading process 510 can be performed. In some embodiments, process block 508 can comprise a post-treatment of the carbon fiber, for example, a second graphitization treatment. For example, the second graphitization treatment of process block 508 can be effective to enhance crystallinity of carbon deposited from the organic compound pyrolysis and/or strengthen bonds within the fiber structure. The result after the second graphitization treatment can be an upgraded, high-quality carbon fiber with enhanced mechanical and electrical properties.

For example, in some embodiments, process block 508 of FIG. 5A can include the graphitization sub-process 540 of FIG. 5C. Sub-process 540 can initiate at process block 542, where an inert gas is provided to a gas enclosure, which may be the same gas enclosure in which organic compound pyrolysis is later performed or a different gas enclosure (e.g., upstream of the pyrolysis enclosure). For example, the inert gas can be argon. The sub-process 540 can proceed to process block 544, where the carbon fiber is subjected to a graphitization heat treatment, which may occur at a temperature greater than the pyrolysis temperature. For example, the graphitization temperature may be in a range of 2000-2773 K, such as ~2100 K. In some embodiments, the carbon fiber can be used as a Joule heating element to generate the temperature for graphitization. The sub-process 540 can proceed to decision block 546, where it is determined if a duration of the graphitization heat treatment has been satisfied. In some embodiments, the graphitization heat treatment is continued for a duration, $t_g$, of 5 minutes or less, for example, ~2 minutes. If the duration is not yet complete, the sub-process 540 returns to process block 544 to maintain the graphitization temperature. Otherwise, if the duration is complete, the sub-process 540 can terminate at terminal 548.

Although illustrated separately, it is contemplated that various process blocks may occur simultaneously or iteratively. For example, first through third stages of process blocks 504-508 can occur simultaneously (e.g., when provided by sequential stations in a continuous manufacturing setup, such as that shown in FIG. 6C) despite being illustrated as sequential process blocks. Furthermore, certain process blocks illustrated as occurring after others may indeed occur before. Although some of blocks 500-562 in FIGS. 5A-5D have been described as being performed once, in some embodiments, multiple repetitions of a particular process block may be employed before proceeding to the next decision block or process block. In addition, although blocks 500-562 in FIGS. 5A-5D have been separately illustrated and described, in some embodiments, process blocks may be combined and performed together (simultaneously or sequentially). Moreover, although FIGS. 5A-5D illustrate a particular order for blocks 502-562, embodiments of the disclosed subject matter are not limited thereto. Indeed, in certain embodiments, the blocks may occur in a different order than illustrated or simultaneously with other blocks.

Systems for Fabricating Upgraded Carbon Fibers

Figure 6A:
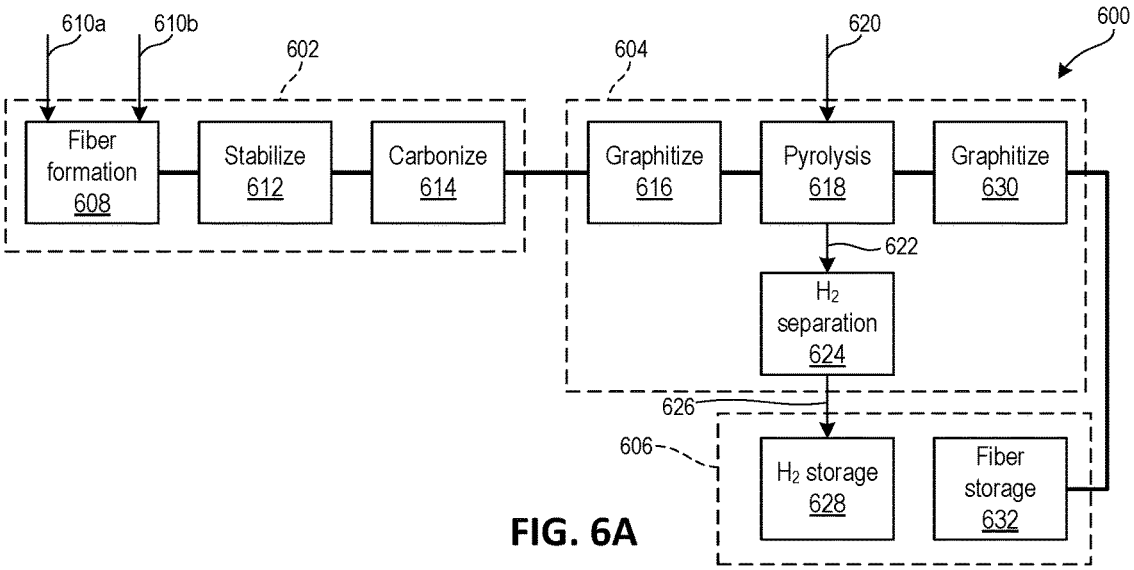
FIG. 6A is a simplified schematic diagram illustrating various stages of a system for fabricating high quality carbon fibers via organic compound pyrolysis, according to one or more embodiments of the disclosed subject matter.
Figure 6B:
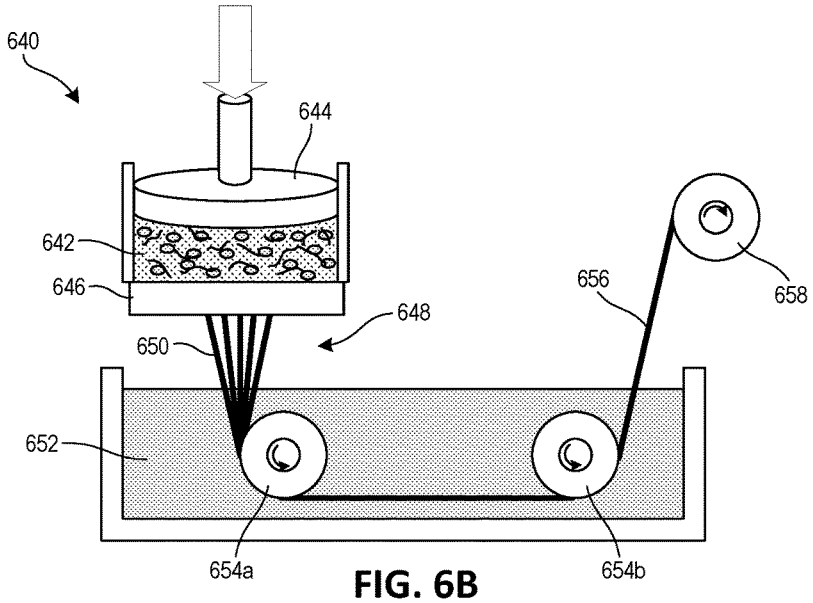
FIG. 6B is a simplified schematic diagram of a stage for forming a low-quality precursor fiber by dry-jet wet spinning, according to one or more embodiments of the disclosed subject matter.

FIG. 6A shows a system 600 for fabricating upgraded carbon fibers. The system 600 can include a low-quality fiber fabrication sub-system 602, a high-quality fiber fabrication sub-system 604, and a product storage sub-system 606. The product storage sub-system 606 can include a gas storage module 628 (e.g., high-pressure gas container) for storage of hydrogen gas therein and/or a fiber storage module 632 (e.g., a product roller). The low-quality fiber fabrication sub-system 602 can include a plurality of separate, sequential stages, for example, a precursor fiber formation stage 608, a stabilization treatment stage 612, and a carbonization treatment stage 614. For example, the precursor fiber formation stage 608 may include a spinning setup that receives inputs of fiber precursors 610*a* and CB particles 610*b* and can operate similar to process blocks 522-526 of sub-process 520 of FIG. 5B described above. The stabilization treatment stage 612 may include a furnace and can operate similar to process block 528 of sub-process 520 of FIG. 5B described above, and the carbonization treatment stage 614 may include another furnace and can operate similar to process block 530 of sub-process 520 of FIG. 5B.

In some embodiments, the stages 608, 612, and 614 can be sequentially arranged for continuous processing, for example, such that a precursor fiber formed by stage 608 is fed into a first furnace of the stabilization treatment stage 612 and such that the precursor fiber exiting the stabilization treatment stage 612 is fed into a second furnace of the carbonization treatment stage 614. Alternatively or additionally, in some embodiments, the processing of one, some, or all of stages 608, 612, and 614 can be on a batch basis. For example, the precursor fiber formed by stage 608 can be wound on a supply roller as it is being continuously fabricated. After a batch of the precursor fiber is completed by stage 608, the supply roller can be delivered to the first furnace for continuous processing therein. Similarly, the output of the stabilization treatment stage 612 can be wound on another roller for subsequent delivery to the carbonization treatment stage 614. In some embodiments, the stabilization and carbonization treatment stages can be performed in the same furnace, for example, by changing an atmosphere within the furnace from air to inert gas before changing temperatures.

The high-quality fiber fabrication sub-system 604 can include a plurality of separate stages, for example, a first graphitization treatment stage 616, a pyrolysis stage 618, a hydrogen separation stage 624, and a second graphitization treatment stage 630. For example, the first graphitization treatment stage 616 and the second graphitization treatment stage 630 may each include a respective furnace and can each operate similar to sub-process 540 of FIG. 5C described above. The pyrolysis stage 618 may include another furnace that receives an input gas stream 620 of organic compound(s) (e.g., methane). The hydrogen separation stage 624 may receive an output gas stream 622 (e.g., a mixture of hydrogen and unreacted organic compound(s)) from the pyrolysis stage 618 and can use a proton exchange membrane to generate an output stream 626 of isolated hydrogen for storage by module 628. Together, the pyrolysis stage 618 and the hydrogen separation stage 624 can operate similar to sub-process 550 of FIG. 5D.

In some embodiments, the stages 616, 618, and 630 can be sequentially arranged for continuous processing, for example, such that a low-quality carbon fiber processed in a first furnace of graphitization stage 616 is fed into a second furnace of the pyrolysis stage 618 and such that the processed fiber exiting the pyrolysis stage 618 is fed into a third furnace of the graphitization treatment stage 630. Alternatively or additionally, in some embodiments, the processing of one, some, or all of stages 616, 618, and 630 can be on a batch basis. For example, the low-quality carbon fiber processed by graphitization stage 616 can be wound on a roller as it is being processed. After a batch of the carbon fiber is completed by stage 616, the roller can be delivered to the next furnace for continuous processing by the pyrolysis stage 618. Similarly, the output of the pyrolysis stage 618 can be wound on another roller for subsequent delivery to the second graphitization stage 630. In some embodiments, the first graphitization stage, the pyrolysis stage, and the second graphitization stage can be performed in the same furnace, for example, by changing an atmosphere within the furnace from inert gas to organic compound, or vice versa, before changing temperatures.

FIG. 6B shows a setup 640 for forming a precursor filament by a dry-jet wet spinning technique. A solution 642 can include polymer fibril precursors and CB particles combined together. For example, CB particles could be first dispersed in DMF using bath sonication (e.g., via application of ultrasound) at room temperature, followed by addition thereto of PAN dissolved in DMF. An actuator 644 (e.g., plunger) is used to extrude the solution 642 through holes in a spinneret 646 into an air gap 648 (e.g., ~3-5 cm), followed by passing of the extruded filaments 650 through a coagulation bath 652 (e.g., mixture of methanol and dimethyl acetamide (70/30 v/v)). Alternatively or additionally, fiber drawing can be performed by passing the fiber through a glycerol bath at ~165° C. (~438 K). The filaments 650 can be directed through bath 652 via rollers 654*a*, 654*b*, such that the resulting CB/PAN precursor fibers 656 can be collected on a winder or supply roller 658. Instead of being collected on supply roller 658, the precursor fibers 656 can be directed to the next stage (e.g., stabilization stage 612) for continuous processing.

Figure 6C:
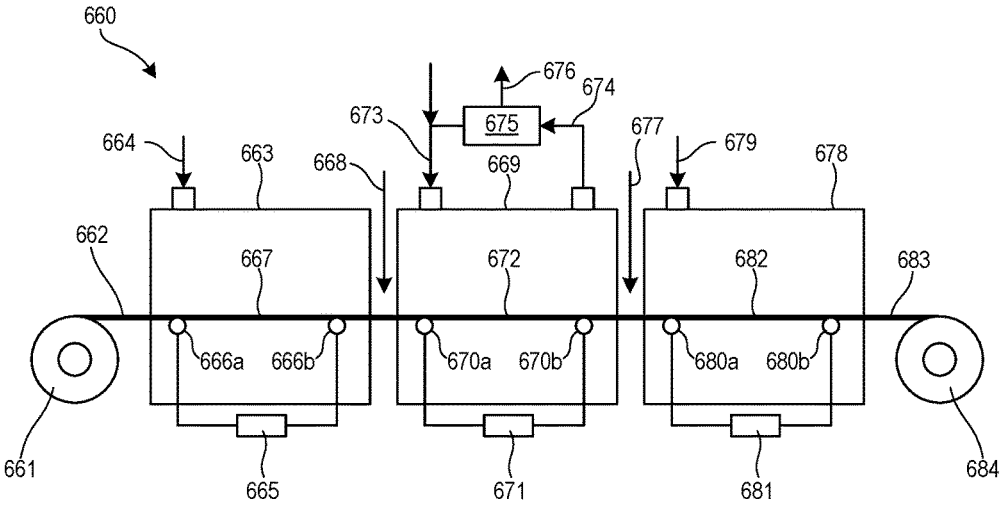
FIG. 6C is a simplified schematic diagram of a stage with multiple furnaces for upgrading a low-quality fiber to a high-quality fiber via organic compound pyrolysis, according to one or more embodiments of the disclosed subject matter.

FIG. 6C shows a setup 660 for a high-quality fiber fabrication sub-system. In the illustrated example, setup 660 includes a first enclosure 663, a second enclosure 669, and a third enclosure 678 serially arranged and corresponding to the first graphitization treatment, pyrolysis, and second graphitization treatment stages, respectively. However, in some embodiments, instead of multiple successive enclosure, each treatment stage can be performed in a single enclosure, for example, by flowing in different gases and changing temperature by providing different currents to the Joule heating element. Alternatively, in some embodiments, enclosures could be provided as separate independent stations rather than the illustrated serial arrangement. For example, the processing in an enclosure for the first graphitization treatment stage can be performed for an entire length of a carbon fiber before the carbon fiber is allowed to proceed to the pyrolysis stage.

In the illustrated example, a supply roller 661 can be used to provide a continuous feed of low-quality carbon fiber 662 into the serially arranged enclosures. For first enclosure 663, conductive rollers 666*a*, 666*b* make electrical contact with a portion 667 of the carbon fiber therein, and an inert gas 664 (e.g., argon) is provided. A current source 665 is connected to the conductive rollers 666*a*, 666*b* and applies a current to the carbon fiber portion 667 that causes Joule heating thereof to effect the first graphitization treatment (e.g., ~2100 K for 2 minutes). Similarly, for third enclosure 678, conductive rollers 680*a*, 680*b* make electrical contact with a portion 682 of the carbon fiber therein, and an inert gas 679 (e.g., argon) is provided. A current source 681 is connected to the conductive rollers 680*a*, 680*b* and applies a current to the carbon fiber portion 682 that causes Joule heating thereof to effect the second graphitization treatment (e.g., ~2100 K for 2 minutes).

In between the first and third enclosures, second enclosure 669 has conductive rollers 670*a*, 670*b* that make electrical contact with a portion 672 of the carbon fiber therein, and organic compound(s) 673 (e.g., methane) is provided. A current source 671 is connected to the conductive rollers 670*a*, 670*b* and applies another current to the carbon fiber portion 672 that causes Joule heating thereof to effect the pyrolysis (e.g., ~1700K for 20 minutes). In the illustrated example, current sources 665, 671, and 681 are shown as separate devices; however, in some embodiments, a single current source with independent outputs could be used to apply the respective current to each stage.

Carbon formed by the pyrolysis is deposited in and/or on the carbon fiber portion 672, while gaseous products 674 are processed by separator 675 (e.g., membrane separator) to yield a stream 676 of isolated hydrogen and a recycle stream for returning to the gas volume of enclosure 669. In some embodiments, the transitions between enclosures can optionally be provided with a shield gas (e.g., inert gas), for example, first shield gas flow 668 and second shield gas flow 677. The shield gas may prevent oxygen in the environment from damaging the carbon fiber as it transitions between stages. Alternatively, in some embodiments, the transitions between enclosures 663, 669, 678 can be via an evacuated environment. A high-quality carbon fiber 683 exiting the final enclosure 678 can be collected for further use or storage, for example, by winding on product roller 684.

Figure 6D:
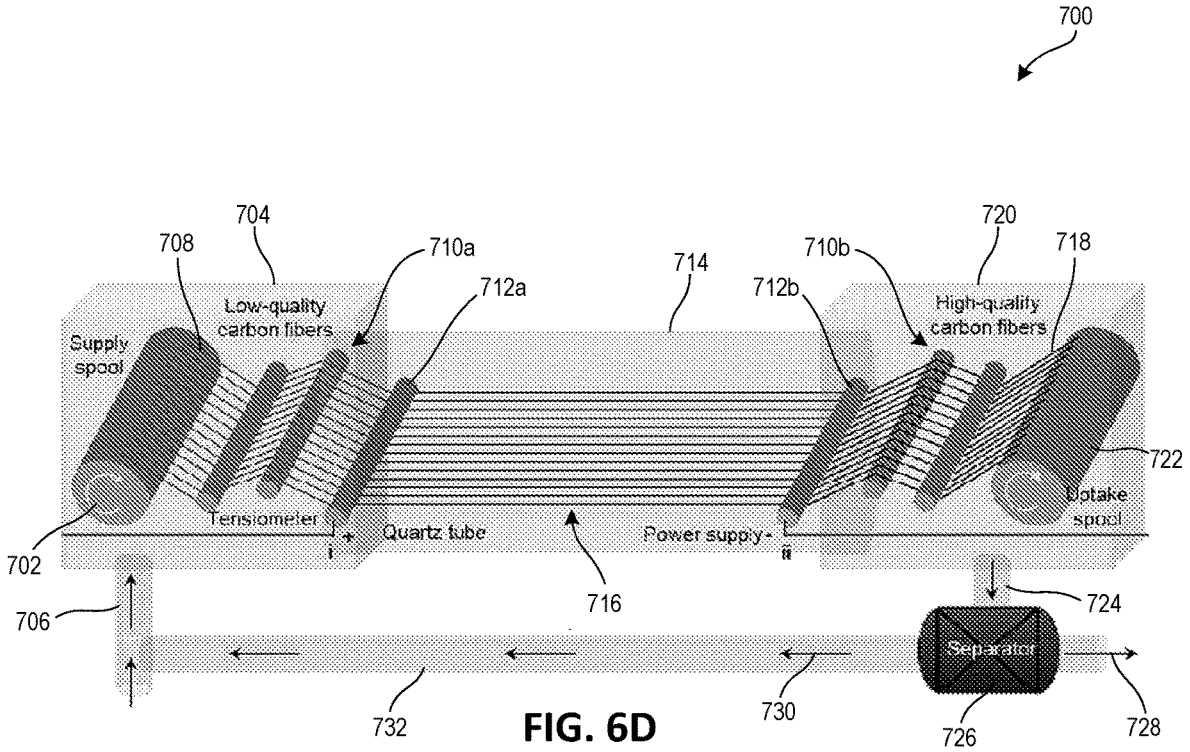
FIG. 6D is a simplified schematic diagram of an organic compound pyrolysis stage for simultaneously upgrading multiple carbon fibers via continuous processing, according to one or more embodiments of the disclosed subject matter.

FIG. 6D illustrates a roll-to-roll setup 700 for the pyrolysis stage of a carbon fiber upgrade. In the illustrated example, separated and aligned low-quality carbon fibers 708 are fed from a supply spool 702 to an inlet tension mechanism 710*a* (e.g., tension-applying servo-mechanism or tensiometer) and directed across conductive rollers 712*a*, 712*b* within pyrolysis enclosure 714 (e.g., quartz tube). The conductive rollers 712*a*, 712*b* serve as electrodes for simultaneous Joule heating of the arrayed portions of fibers 708 within region 716, while also maintaining the tension as the fibers 708 are translated. An upgrading atmosphere (e.g., methane and/or argon/nitrogen) can be supplied to the enclosure 714 via inlet port 706 and inlet manifold 704. The tension, applied current, and residence time can be accurately programmed, and the temperature can also be monitored with an optical thermal sensor. After passing through the electrified rollers 712*a*, 712*b*, the resulting upgraded fibers 718 are collected on an uptake spool 722 via outlet tension mechanism 710*b* (e.g., tension-applying servo-mechanism or tensiometer). Gases from enclosure 714 can be directed to outlet port 724 via outlet manifold 720. The outlet gases can be further processed by separator 726 (e.g., membrane separator) to isolate a stream 728 of hydrogen while the remaining gases 730 (e.g., effluent stream of unreacted methane) are redirected back to the inlet port 706 via recycle line 732 for reprocessing.

Computer Implementation

Figure 7:
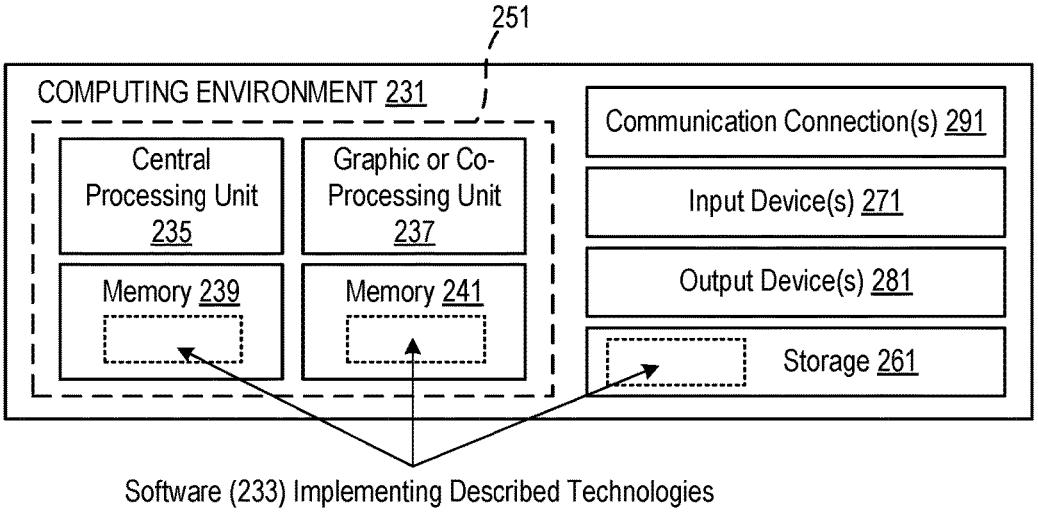
FIG. 7 depicts a generalized example of a computing environment in which the disclosed technologies may be implemented.

FIG. 7 depicts a generalized example of a suitable computing environment 231 in which the described innovations may be implemented, such as aspects of controller 126, method 400, method 500, sub-process 520, sub-process 540, sub-process 550, a controller of system 600, a controller of setup 640, a controller of setup 660, or a controller of setup 700. The computing environment 231 is not intended to suggest any limitation as to scope of use or functionality, as the innovations may be implemented in diverse general-purpose or special-purpose computing systems. For example, the computing environment 231 can be any of a variety of computing devices (e.g., desktop computer, laptop computer, server computer, tablet computer, etc.).

With reference to FIG. 7, the computing environment 231 includes one or more processing units 235, 237 and memory 239, 241. In FIG. 7, this basic configuration 251 is included within a dashed line. The processing units 235, 237 execute computer-executable instructions. A processing unit can be a central processing unit (CPU), processor in an application-specific integrated circuit (ASIC), or any other type of processor (e.g., hardware processors, graphics processing units (GPUs), virtual processors, etc.). In a multi-processing system, multiple processing units execute computer-executable instructions to increase processing power. For example, FIG. 7 shows a central processing unit 235 as well as a graphics processing unit or co-processing unit 237. The tangible memory 239, 241 may be volatile memory (e.g., registers, cache, RAM), non-volatile memory (e.g., ROM, EEPROM, flash memory, etc.), or some combination of the two, accessible by the processing unit(s). The memory 239, 241 stores software 233 implementing one or more innovations described herein, in the form of computer-executable instructions suitable for execution by the processing unit(s).

A computing system may have additional features. For example, the computing environment 231 includes storage 261, one or more input devices 271, one or more output devices 281, and one or more communication connections 291. An interconnection mechanism (not shown) such as a bus, controller, or network interconnects the components of the computing environment 231. Typically, operating system software (not shown) provides an operating environment for other software executing in the computing environment 231, and coordinates activities of the components of the computing environment 231.

The tangible storage 261 may be removable or non-removable, and includes magnetic disks, magnetic tapes or cassettes, CD-ROMs, DVDs, or any other medium which can be used to store information in a non-transitory way, and which can be accessed within the computing environment 231. The storage 261 can store instructions for the software 233 implementing one or more innovations described herein.

The input device(s) 271 may be a touch input device such as a keyboard, mouse, pen, or trackball, a voice input device, a scanning device, or another device that provides input to the computing environment 231. The output device(s) 271 may be a display, printer, speaker, CD-writer, or another device that provides output from computing environment 231.

The communication connection(s) 291 enable communication over a communication medium to another computing entity. The communication medium conveys information such as computer-executable instructions, audio or video input or output, or other data in a modulated data signal. A modulated data signal is a signal that has one or more of its characteristics set or changed in such a manner as to encode information in the signal. By way of example, and not limitation, communication media can use an electrical, optical, radio-frequency (RF), or another carrier.

Any of the disclosed methods can be implemented as computer-executable instructions stored on one or more computer-readable storage media (e.g., one or more optical media discs, volatile memory components (such as DRAM or SRAM), or non-volatile memory components (such as flash memory or hard drives)) and executed on a computer (e.g., any commercially available computer, including smartphones or other mobile devices that include computing hardware, for example, such as industrial and/or non-industrial IoT "Internet of Things" devices). The term computer-readable storage media does not include communication connections, such as signals and carrier waves. Any of the computer-executable instructions for implementing the disclosed techniques as well as any data created and used during implementation of the disclosed embodiments can be stored on one or more computer-readable storage media. The computer-executable instructions can be part of, for example, a dedicated software application or a software application that is accessed or downloaded via a web browser or other software application (such as a remote computing application). Such software can be executed, for example, on a single local computer (e.g., any suitable commercially available computer) or in a network environment (e.g., via the Internet, a wide-area network, a local-area network, a client-server network (such as a cloud computing network), or any other such network) using one or more network computers.

For clarity, only certain selected aspects of the software-based implementations are described. Other details that are well known in the art are omitted. For example, it should be understood that the disclosed technology is not limited to any specific computer language or program. For instance, aspects of the disclosed technology can be implemented by software written in C++, Java™, Python®, and/or any other suitable computer language. Likewise, the disclosed technology is not limited to any particular computer or type of hardware. Certain details of suitable computers and hardware are well known and need not be set forth in detail in this disclosure.

It should also be well understood that any functionality described herein can be performed, at least in part, by one or more hardware logic components, instead of software. For example, and without limitation, illustrative types of hardware logic components that can be used include Field-programmable Gate Arrays (FPGAs), Program-specific Integrated Circuits (ASICs), Program-specific Standard Products (ASSPs), System-on-a-chip systems (SOCs), Complex Programmable Logic Devices (CPLDs), etc.

Furthermore, any of the software-based embodiments (comprising, for example, computer-executable instructions for causing a computer to perform any of the disclosed methods) can be uploaded, downloaded, or remotely accessed through a suitable communication means. Such suitable communication means include, for example, the Internet, the World Wide Web, an intranet, software applications, cable (including fiber optic cable), magnetic communications, electromagnetic communications (including RF, microwave, and infrared communications), electronic communications, or other such communication means. In any of the above-described examples and embodiments, provision of a request (e.g., data request), indication (e.g., data signal), instruction (e.g., control signal), or any other communication between systems, components, devices, etc. can be by generation and transmission of an appropriate electrical signal by wired or wireless connections.

Fabricated Examples and Experimental Results

Poly(acrylonitrile-co-methacrylic acid) (PAN, 4 wt % copolymers) with viscosity average molecular weight of 500,000 g/mol was used as the polymer binder. Thermal carbon black (CB) particles having diameters in a range of 200-400 nm, inclusive, were produced by the thermal decomposition of natural gas (e.g., methane) via traditional combustion. The CB particles were dried at 110° C. (383 K) for 4 hours before use to desorb any moisture. Dimethylformamide (DMF, ACS grade, 99.8%) was used as a solvent for both the PAN and CB. In particular, to prepare the CB/PAN solution, CB particles were first dispersed on DMF via 24 hours sonication at a concentration determined by the target solid content. CB/PAN solutions were prepared by mixing dried PAN with chilled (0° C. (273 K)) DMF/CB solution for 1 hour, followed by a temperature increase to 70° C. (343 K) and further stirring for another 2 hours. After 2-hour stirring, the fiber formability of the solution was checked. Based on the fiber formability and viscosity measurement, any excess DMF was evaporated until a fiber-forming solution was obtained.

Dry-jet wet spinning was performed using a single filament system, in particular, by extruding spinning dispersions of CB/PAN solutions through a spinneret hole (e.g., 200 μm, 250 μm) into an air gap of 3 to 5 cm, followed by a coagulation bath of methanol and dimethylacetamide (70/30 v/v). The fiber drawing was done while passing the fiber through a glycerol bath at ~165° C. (~438 K). Increasing the CB content of the CB/PAN precursor fibers could pose several challenges to the spinning process. For example, while individual CB particles may be sufficiently small to pass through a spinneret without issue, particles can agglomerate to a larger effective size, which could result in the spinneret becoming clogged and disrupting the jetting of solution. This potential logically increases with greater CB particle concentration. Additionally, higher CB content may reduce the drawability of the fibers, both as-spun and hot-drawn, which can contribute to an increased fiber diameter and/or reduced mechanical properties.

Low-cost carbon fibers composed of CB and PAN-induced carbon (CB/PAN carbon fibers) were first synthesized. In particular, a series of CB/PAN carbon fibers with different CB contents (denoted as x-CB/(100-x)-PAN, where x=20, 30, 40, 60, and 70 wt %) were synthesized. First, dry-jet wet spinning was used to extrude spinning dispersions of the fiber-forming CB/PAN solutions, in which the continuous precursor filaments were spun at a large scale with spinning 30 km-length fiber per hour. The as-spun precursor filament exhibits a network of aligned carbon fibrils (e.g., nanofibers), with CB particles attached to or embedded within the fibrils, as shown in FIGS. 2C-2D.

Figure 8A:
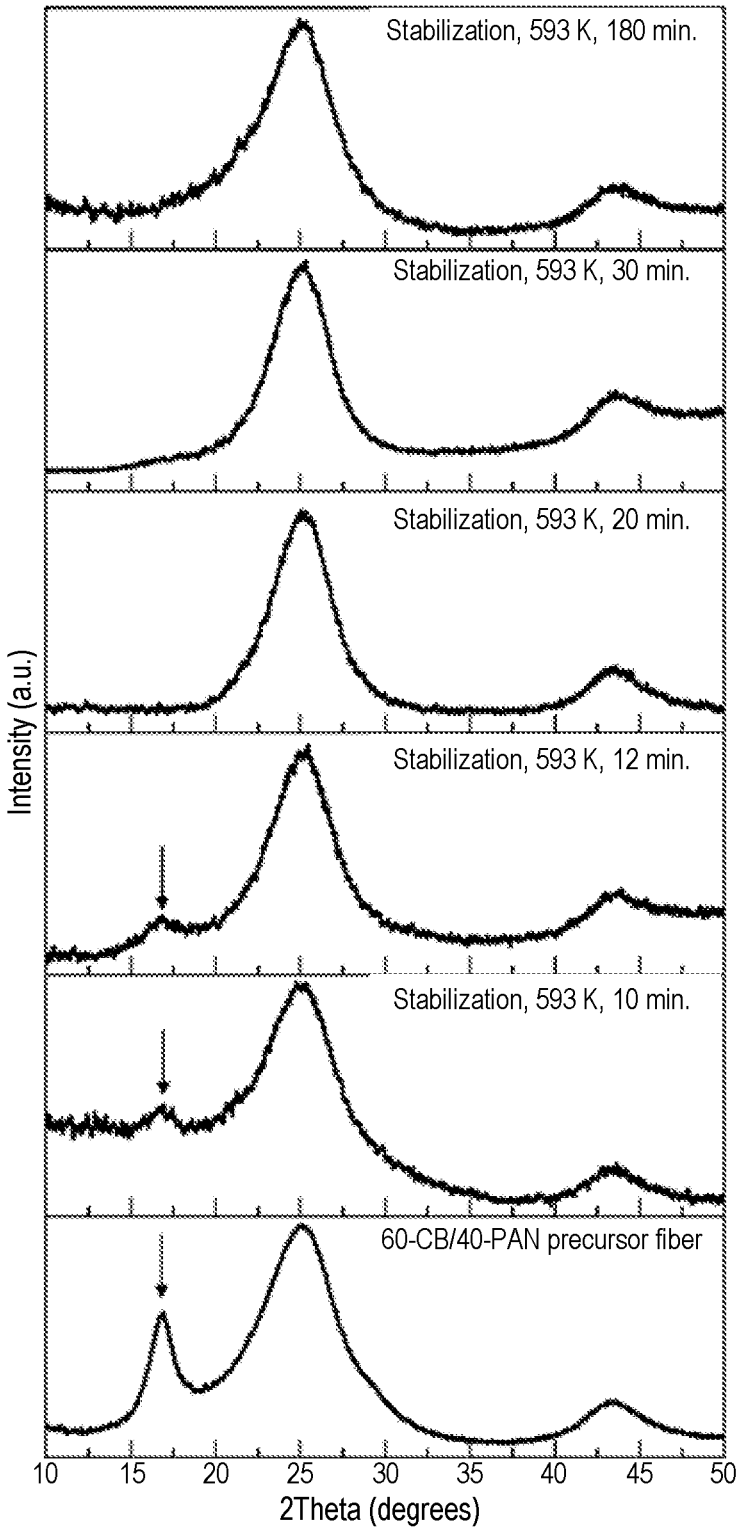
FIG. 8A illustrates integrated wide-angle X-ray diffraction (WAXD) scans for 60% carbon black and 40% PAN precursor fiber at various stabilization treatment times in air.

Stabilization (heating at a rate of 3 K/minute to 593 K, followed by a 20 minute isothermal hold at 593 K in air) and carbonization (heating in nitrogen atmosphere from room temperature (e.g., ~20° C. (~293 K)) to 1588 K at a rate of 4-5 K/min, followed by a 10 minute isothermal hold at 1588 K, and then cooling to room temperature at a 4-5 K/min ramp-down) were then performed on the spun CB/PAN precursor filaments by furnace heating (convection heating), to form the final CB/PAN carbon fibers. All stabilizations were conducted on fiber bundles of at least 150 μm equivalent diameter. During stabilization and carbonization, a stress (depending on the various CB contents, e.g., 10-15 MPa for 20-CB/80-PAN and 30-CB/70-PAN; 5 MPa for 40-CB/60-PAN, 60-CB/40-PAN, and 70-CB/30-PAN) was applied. FIG. 8A shows the results of various stabilization treatment times in air on a 60-CB/40-PAN precursor filament. The oxidation and cyclization during the PAN stabilization depend on oxygen diffusion throughout the fiber and the reaction temperature. During stabilization, the oxygen diffusion is affected by the presence of the voids in CB/PAN precursor filaments, resulting in an increase in oxygen diffusion that significantly reduces the stabilization time. After 20 minutes of convection furnace stabilization, the PAN diffraction peak at about 17 degrees was lost during stabilization, confirming the stabilization of CB/PAN fiber is completed in 20 minutes, rather than the normal 2-3 hours for the PAN fiber.

After the carbonization, these CB/PAN carbon fibers could then be upgraded by in situ Joule heating, for example, by heating in an atmosphere comprising methane. The Joule heating system included calibrated mass flow controllers, a microflow quartz reactor (inner diameter of ½ inch, length of 8 inch), and an external power source. The low-quality CB/PAN carbon fibers were suspended within the flow reactor, and opposite ends of the fibers were connected to the power source. By applying a current to the fibers, in situ Joule heating can be achieved, in which the temperature and heating time is controlled by adjusting the magnitude and duration of the applied current. To measure temperature of the Joule heating element, a high-speed light camera was used. During high-temperature upgrading, carbon deposition or carbon binding could induce decreases in resistance of the carbon fibers over time, especially during the second-stage methane pyrolysis. Thus, monitoring by the light camera of the emitted spectrum can be used to adjust the applied current to compensate for such resistance changes, so as to maintain a desired temperature in real-time, or substantially in real-time.

The heating temperature of the fiber can be used to control the material's crystallinity, the deposition of carbon from the methane pyrolysis reaction, and the promotion of carbon bonding, which could be used to modify the fiber's microstructure and mechanical and/or electrical properties. In a particular, a three-stage heating process was used to densify the microstructure of the CB/PAN carbon fibers, for example, a first stage of graphitizing in argon, a second stage of carbon deposition in methane, and a third stage of further graphitizing in argon. During the first-stage and third-stage (e.g., graphitization stages, 2100 K for 2 minutes in argon), a constant current was applied to the Joule heating element. During the second-stage (e.g., methane pyrolysis stage, 1700 K for 20 minutes, which is approximately the minimum temperature required for complete cracking of methane without use of a catalyst), an initial current was applied, and then gradually increased at a rate of ~0.03 A/minute. During these stages, the gas flow rate of methane or argon into the reactor was set at 3 sccm.

In the first stage, a temperature of 2100 K (e.g., larger than the carbonization temperature of 1588 K) was applied for 2 minutes in argon to graphitize the CB/PAN carbon fiber. While SEM images of the resulting fiber show minimal change in the morphology (at least as compared to an untreated sample), the high-degree Crystallization for the PAN-induced carbon and the close interaction between CB and PAN-induced carbon were observed in the 60-CB/40-PAN carbon fiber after graphitizing. In a control experiment, a higher graphitizing temperature of 2500 K was found to result in obvious shrinkage of the 60-CB/40-PAN carbon fiber, thus destroying the fiber microstructure. A suitable temperature in the initial graphitization step therefore contributes to the enhanced crystallinity of the PAN-induced carbon and strengthened bonding between the CB and PAN-induced carbon.

Figure 8B:
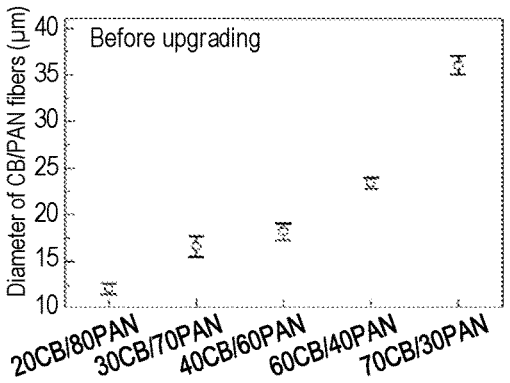
FIGS. 8B and 8D are graphs of diameter for CB/PAN carbon fibers with different CB content before and after upgrading, respectively.
Figure 8C:
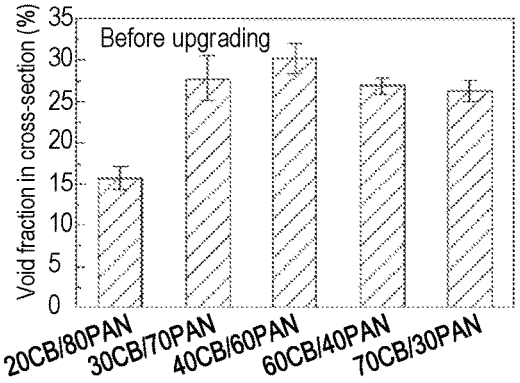
FIGS. 8C and 8E are graphs of cross-sectional void fraction for CB/PAN carbon fibers with different CB content before and after upgrading, respectively.
Figure 8D:
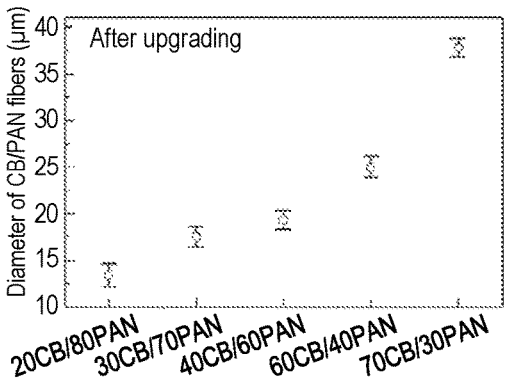
Figure 8E:
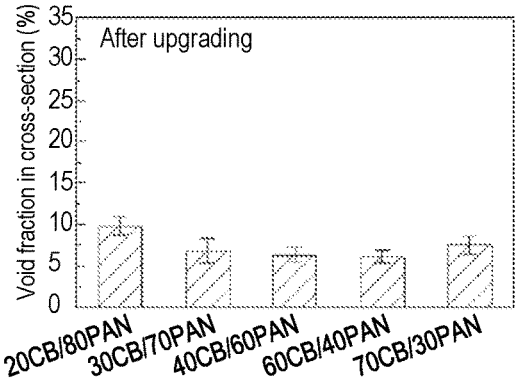

FIGS. 8B-8E show the structural characteristics (e.g., diameter and void fraction) of the CB/PAN carbon fibers prior to (e.g., as low-quality fibers) and after upgrading (e.g., as high-quality fibers). As shown in FIGS. 8B and 8D, the diameter of various CB/PAN carbon fibers increases with increasing CB content. Moreover, as is apparent from a comparison of FIGS. 8B and 8D, the upgraded CB/PAN carbon fibers have diameters that are greater than that of the corresponding low-quality fiber, in particular, due to the carbon deposition from the methane pyrolysis. In addition, as is apparent from a comparison of FIGS. 8C and 8E, void fraction (e.g., the area of the cross-section divided by the area of the voids in the cross-section) decreases significantly for the upgraded CB/PAN carbon fibers as compared to the corresponding low-quality fiber, in particular, due to the methane-derived carbon filling these voids. The decreased void fractions and densified microstructures of the upgraded CB/PAN carbon fibers result in enhanced mechanical and electrical properties, and increased methane-produced carbon as compared to the starting fiber materials.

Figure 9A:
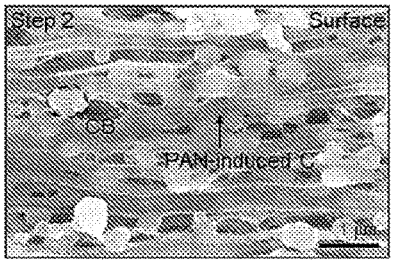
FIGS. 9A-9C are SEM images of the surface morphology of a carbon fiber formed of 60% carbon black and 40% PAN at 4 minutes, 12 minutes, and 20 minutes, respectively, during methane pyrolysis.
Figure 9B:
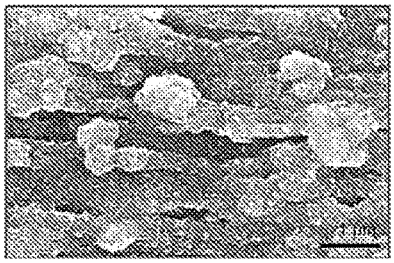
Figure 9C:
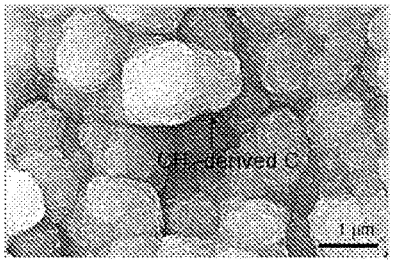
Figure 10A:
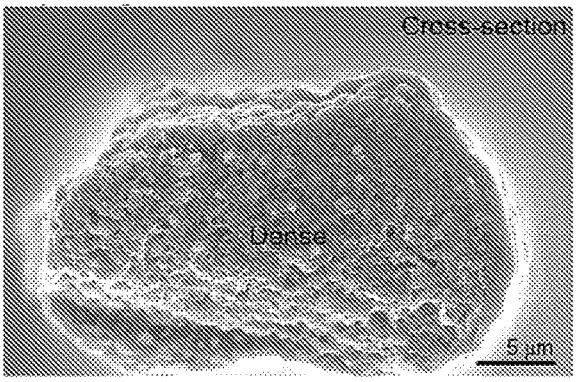
FIGS. 10A-10B are SEM images of the cross-sectional morphology of a carbon fiber formed of 60% carbon black and 40% PAN after methane pyrolysis at 1700 K for 20 minutes.
Figure 10B:
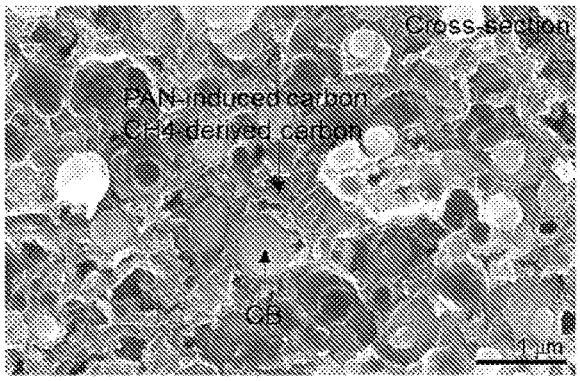
Figure 10C:
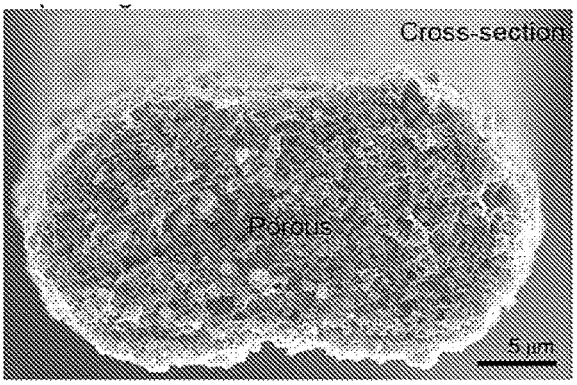
FIGS. 10C-10D are SEM images of the cross-sectional morphology of a carbon fiber formed of 60% carbon black and 40% PAN after methane pyrolysis at 1300 K for 20 minutes.
Figure 10D:
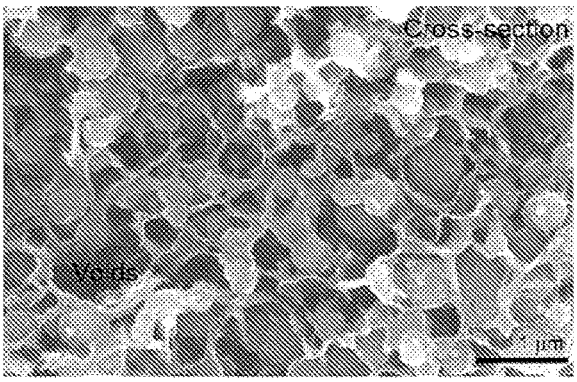
Figure 10E:
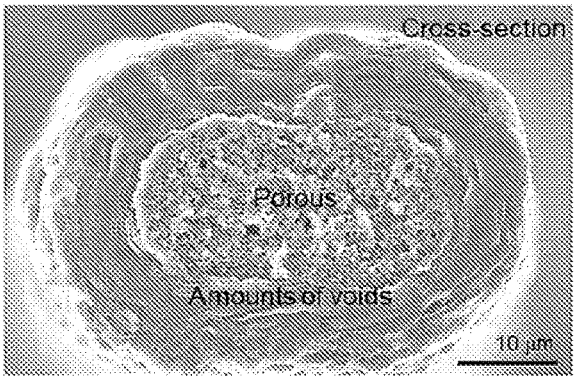
FIGS. 10E-10F are SEM images of the cross-sectional morphology of a carbon fiber formed of 60% carbon black and 40% PAN after methane pyrolysis at 2100 K for 20 minutes.
Figure 10F:
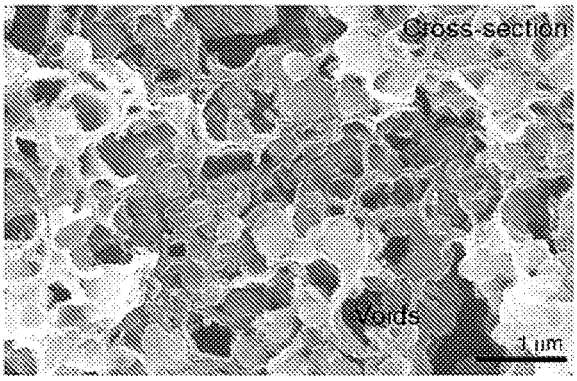

In the second heating stage, as the heating time increased, the voids in the fiber were gradually filled by the methane-deposited carbon, as shown in FIGS. 9A-9C, thus forming a dense microstructure, as shown in FIG. 10A. In contrast, as shown in FIG. 10B, a lower treatment temperature of 1300 K for 20 min was insufficient to promote the complete pyrolysis of methane to fill the gaps in the 60-CB/40-PAN carbon fiber, for example, due to slow reaction kinetics. Moreover, as shown in FIG. 10C, a higher treatment temperature of 2100 K for 10 minutes leads to unfilled voids in the core and a thick crust on the shell, likely due to the rapid carbon deposition on the surface that hinders methane and/or carbon diffusion to the core. Therefore, the treatment temperature can yield different fiber microstructures, and the rate of methane gas diffusion inside the fiber may be balanced with the rate of carbon deposition to achieve a desired microstructure and/or fiber properties. As noted above, during the second heating stage, methane pyrolysis also produces hydrogen gas as a value-added product with high selectivity.

Figure 3C:
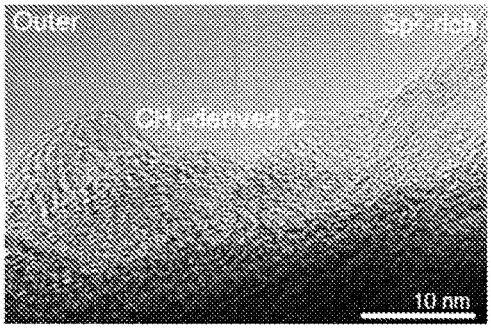
FIGS. 3C-3D are high-resolution transmission electron microscopy (HR-TEM) images showing outer and inner structure, respectively, of the carbon fiber formed of 60% carbon black and 40% PAN after upgrading via organic compound pyrolysis, according to one or more embodiments of the disclosed subject matter.
Figure 3D:
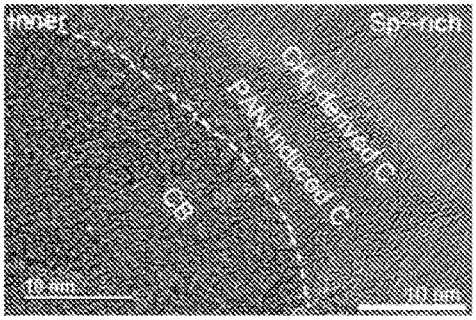
Figure 3E:
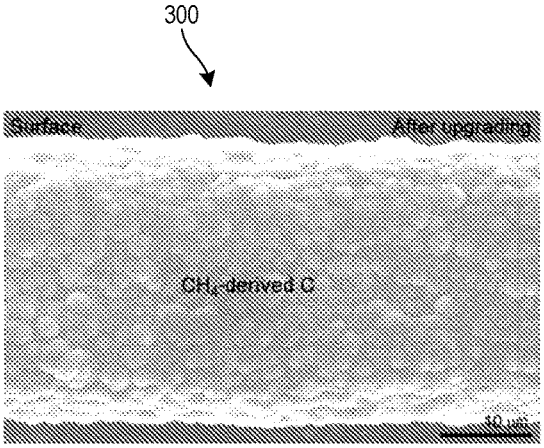
FIGS. 3E-3F are SEM images illustrating surface and cross-sectional morphologies, respectively, of the carbon fiber formed of 60% carbon black and 40% PAN after upgrading via organic compound pyrolysis, according to one or more embodiments of the disclosed subject matter.
Figure 3F:
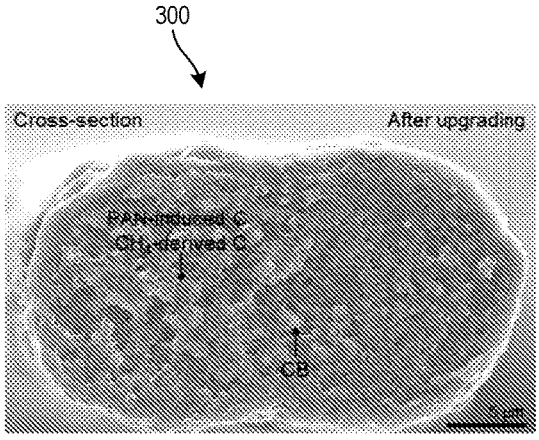
Figure 11A:
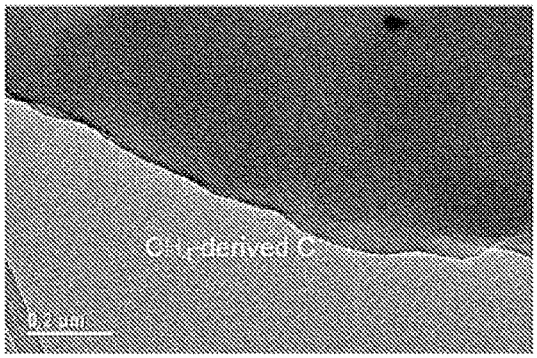
FIGS. 11A-11B are TEM images of a carbon fiber formed of 60% carbon black and 40% PAN before a second graphitizing process.
Figure 11B:
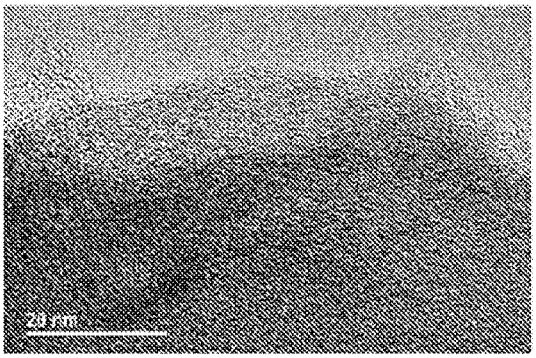
Figure 11C:
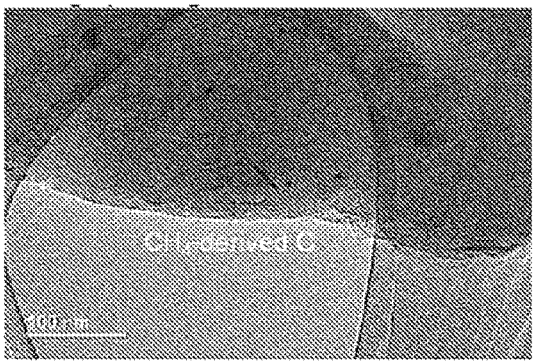
FIGS. 11C-11D are TEM images of the carbon fiber formed of 60% carbon black and 40% PAN after a second graphitizing process.
Figure 11D:
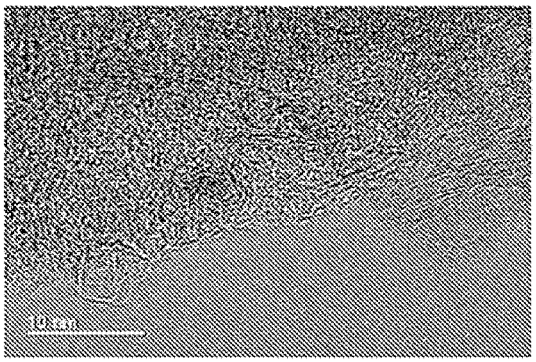
Figure 11E:
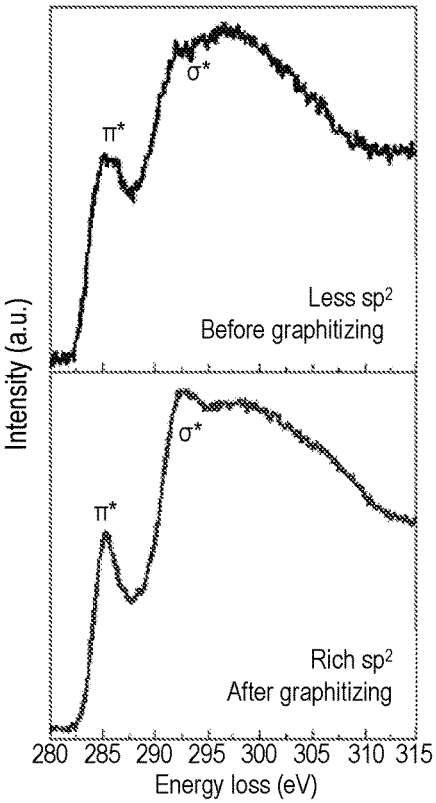
FIG. 11E is a graph of electron energy-loss spectra (EELS) of the carbon fiber formed of 60% carbon black and 40% PAN before and after the second graphitizing process.

In the third heating stage (e.g., further graphitization), the same heating profile as in the first heating stage (e.g., ~2100 K for 2 minutes in argon) was used to promote the formation of more $sp^2$-rich carbon, especially from methane-derived carbon, for achieving high-performance fibers. FIGS. 3E-3F show the surface and cross-sectional morphologies of the 60-CB/40-PAN carbon fiber after graphitizing, which morphologies are similar to the fiber before graphitizing (e.g., as shown in FIG. 10A), both showing dense structures. Microscopically, the outer surface (composed of methane-derived carbon, as shown in FIG. 3D) after graphitizing has more $sp^2$ carbon due to the increased intensity of the $\sigma^*$ bond compared with the fiber before graphitizing, as reflected in FIGS. 11A-11E. The inner core of the fiber was composed of CB, and methane-derived and PAN-induced carbon species also showed $sp^2$-rich carbon. The increased intensity of the $\sigma^*$ bond in FIG. 11E indicates a rich-$sp^2$ structure in the outer surface of the fiber. Thus, after this third heating stage, there is $sp^2$-rich carbon in the fibers, indicating successful graphitization. Before graphitizing, the deposited methane-derived carbon from the second stage is primarily amorphous carbon. After graphitizing again, the amorphous carbon is made more crystalline.

After optimizing the electrification parameters for all three heating stages, the process was performed on CB/PAN carbon fibers with different CB content, which resulted in substantially-densified microstructures for the different samples. For each of the samples, regardless of the CB content, the methane-derived carbon filled the voids and gaps between the CB particles and the PAN-induced carbon fibrils, and also deposited on the surface of the CB/PAN carbon fibers. As a result, the void fractions of the upgraded CB/PAN carbon fibers decreased, and their fiber diameters increased as compared to the original low-quality CB/PAN carbon fibers (e.g., as reflected in the data of FIGS. 8B-8D). For example, the low-quality 60-CB/40-PAN carbon fiber had a diameter of 23.4±0.6 μm and a void fraction of 26.9±1.0%, while the corresponding upgraded 60-CB/40-PAN fiber had a diameter of 25.0±1.2 μm and a void fraction of 6.1±0.8%.

Figure 12A:
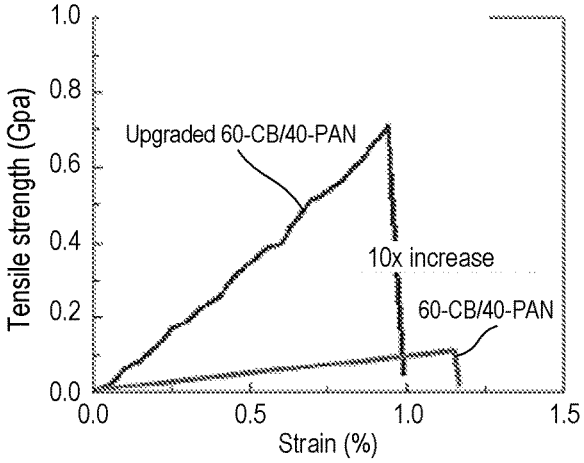
FIG. 12A is a stress-strain curve for a carbon fiber formed of 60% carbon black and 40% PAN before and after upgrading.
Figure 12B:
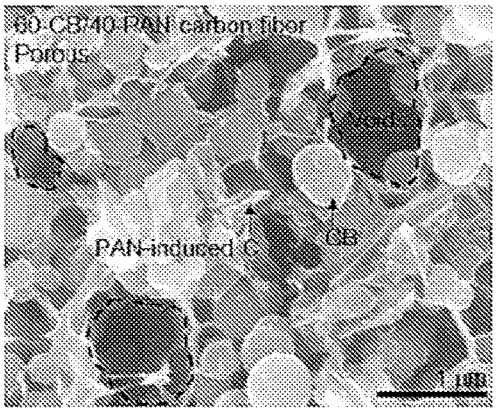
FIGS. 12B-12C are SEM images of the cross-sectional morphology of a carbon fiber formed of 60% carbon black and 40% PAN before and after upgrading.
Figure 12C:
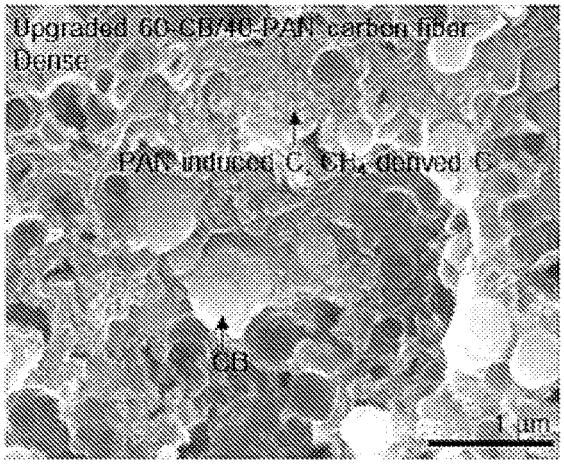

Moreover, the tensile strength of the upgraded 60-CB/40-PAN carbon fiber dramatically increased by ~10-fold, from ~70 MPa (before upgrading) to ~700 MPa (after upgrading), as shown in FIG. 12A. In each stage of the upgrading process (e.g., graphitization, methane pyrolysis, and further graphitization), the fiber strength is further improved as compared to the original low-quality fiber. As shown in FIGS. 2F and 12B, the low-quality 60-CB/40-PAN carbon fiber prior to upgrading exhibits a porous structure. In contrast, the corresponding high-quality carbon fiber after upgrading exhibits a dense structure, as shown in FIGS. 3F and 12C. The process of carbon deposition from methane pyrolysis fills the voids between the adjacent CB particles and joins the CB and PAN-induced carbon fibrils together upon upgrading, which improves fiber performance.

In situ fracture experiments were also performed for the 60-CB/40-PAN precursor fibers before and after upgrading, as well as pure PAN carbon fiber (100% PAN). The aligned PAN nanofibrils in the low-quality 60-CB/40-PAN precursor fiber were broken one by one when applying strain, suggesting that prior to upgrading the precursor fiber lacks integrity (i.e., the nanofibrils loosely attached to each other instead of bonded together), thereby resulting in poor mechanical strength. In contrast, the upgraded 60-CB/40-PAN carbon fiber was broken as a whole, similar to the behavior of the pure PAN carbon fiber. The upgraded 60-CB/40-PAN carbon fiber also demonstrated a more aligned orientation compared with the low-quality sample, which may also be beneficial for improved mechanical and electrical properties.

Figure 12D:
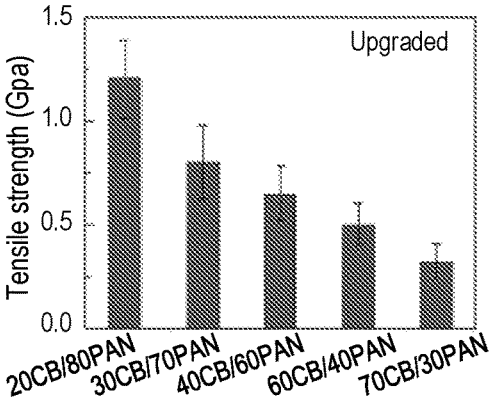
FIGS. 12D-12F are graphs of tensile strength, electrical conductivity, and carbon content for carbon fibers with different CB content.
Figure 12E:
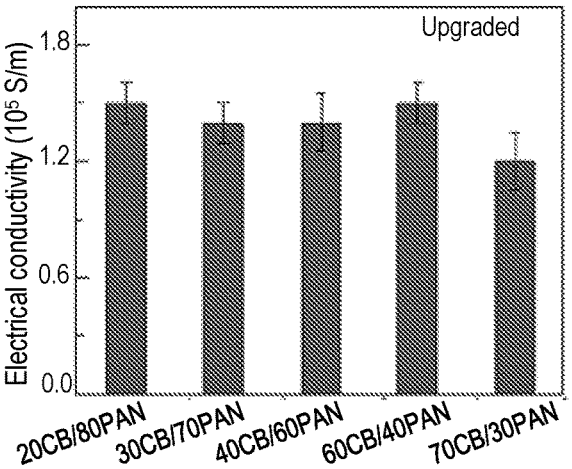

As shown in FIG. 12D, the tensile strength of the upgraded CB/PAN carbon fibers increases with decreasing CB content, in which the upgraded 20-CB/80-PAN carbon fibers showed the highest tensile strength of 1.2 GPa and modulus of 120 GPa. In addition, the upgraded CB/PAN carbon fibers all display an improved high electrical conductivity (e.g., ~$1.5\times10^5$ S/m for the upgraded 20-CB/80-PAN fiber, as shown in FIG. 12E), which conductivities are comparable to commercial carbon fibers. For example, the electrical conductivity of the 60-CB/40-PAN carbon fiber can be substantially increased by ~20-fold, from $7.5\times10^3$ S/m (low-quality fiber) to $1.5\times10^5$ S/m (upgraded fiber). Without being bound by any particular theory, the high mechanical and electrical properties of the upgraded CB/PAN carbon fibers are believed to be due to (1) the dense and integrated structure from carbon deposition into the inner fiber core and on the outer surface and thus close carbon interactions between the CB, PAN-induced carbon, and methane-derived carbon (e.g., as shown in FIGS. 3C and 12C); and (2) the rich $sp^2$ carbon in the whole fiber with methane-derived amorphous carbon converting to crystalline carbon (e.g., as shown in FIG. 3D).

Figure 12F:
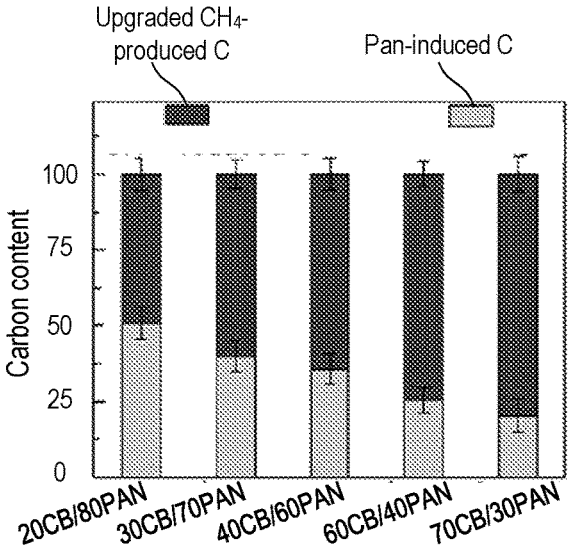

In addition to the improved mechanical and electrical properties, the upgraded CB/PAN carbon fibers also feature cost advantages based on the incorporation of methane-produced carbon. For example, since the deposited carbon species and the CB filler can both originate from methane, the upgraded CB/PAN carbon fibers involve a large amount of methane-produced carbon (i.e., CB spun with PAN to form precursor filament, and deposited carbon from methane pyrolysis during second stage treatment), which can substantially reduce the PAN usage (as shown in FIG. 12F) and therefore the cost. The content of PAN-induced carbon can be decreased to 20 wt %, while that of methane-produced carbon can be increased to 80 wt %. In one example, the upgraded 20-CB/80-PAN carbon fiber, which contained 50 wt % PAN-induced carbon and 50 wt % $CH_4$-produced carbon, can have the best mechanical and electrical properties among the studied examples.

Cost to fabricate the upgraded CB/PAN carbon fibers was analyzed based on the costs of raw materials, electricity, and the other non-variable processes to yield a baseline cost of \$3.62/kgC, which is lower than that of pure PAN carbon fiber (e.g., \$9.88/kgC for U.S. Oak Ridge National Laboratory's carbon fiber line process). At the price of <\$5.0/kgC, the excellent mechanical/electrical properties of the upgraded CB/PAN carbon fibers promise broad applications with great economic benefits such as protective and anti-static casings in the electronics industry. In addition, the upgraded carbon fibers can potentially replace glass fiber in many areas such as chemical/corrosive resistant structural components in chemical and food production, cooling towers, and corrosion-sensitive ocean-based structures.

During upgrading carbon fibers in methane, the gas products were collected at the outlet of the reactor. To analyze gas product composition, a gas tight syringe was used to extract ~50 μL of the collected gas sample and to inject it into the injection port of a gas chromatography system. A thermal conductivity detector (TCD) in the gas chromatography system was used to quantify the amount of hydrogen, methane, and argon in the outlet sample. The potential and practicality of the catalyst-free and electrified approach to conduct methane pyrolysis reaction was analyzed. First, the upgraded CB/PAN carbon fiber can sell at prices of \$10.0-15.0/kgC based on commercial PAN carbon fibers with comparable performance. Subtracting the production cost (i.e., \$3.62/kgC), the value of upgraded CB/PAN carbon fibers remains ~\$10.0/kgC, which features a ~10-times increase compared to that by conventional methane pyrolysis methods (i.e., carbon black, which has a low value of <\$1.0/kgC). These economic benefits come along with a high hydrogen yield of ~82% (i.e., a high $H_2$ selectivity of ~90%×a high $CH_4$ conversion of ~91%).

Second, the $H_2$ generation from the $CH_4$ pyrolysis reaction can achieve minimal $CO_2$ footprint and low cost. Compared with industrial $H_2$ production via steam reforming of $CH_4$, the disclosed Joule heating method offers the potential for zero $CO_2$ footprint (e.g., 0 kg-$CO_2$/kg-$H_2$ vs. 9-14 kg-$CO_2$/kg-$H_2$), for example, when using renewable electricity. Compared with zero-emission $H_2$ generation via electrolysis of water, which can also employ intermittent renewable electricity, the disclosed $CH_4$ pyrolysis via electric Joule heating can generate $H_2$ at a significantly reduced cost (~\$1.0/kg-$H_2$) along with the generation of high-value carbon products.

Figure 13B:
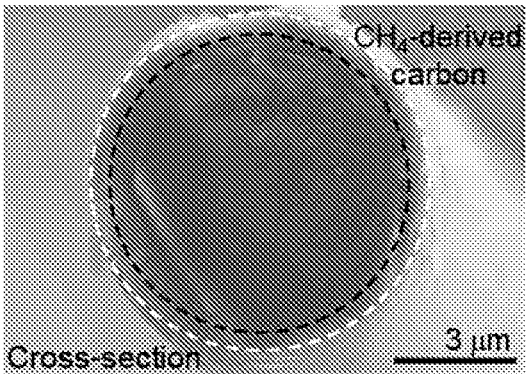

The disclosed methane pyrolysis via Joule heating can be applied to upgrade, or at least improve, other types of carbon materials or carbon fibers, such as but not limited to lignin-based carbon fibers, pitch-based carbon fibers, or commercial PAN-based carbon fibers. To demonstrate the viability of this approach, the commercial PAN-based carbon fibers of FIG. 13A were upgraded. Using the three-stage heating process (but with the heating time for the methane pyrolysis second step being ~5 minutes), the surface of the carbon fiber was uniformly coated with a layer of methane-deposited carbon, as shown in FIG. 13B. As a result, the tensile strength of the fiber increased by ~9% (e.g., from 3.5 GPa to 3.8 GPa) after upgrading due to carbon deposition and graphitization, and the PAN usage accordingly decreased (e.g., from 100% to <80%) due to the incorporation of methane-derived carbon.

Additional Examples of the Disclosed Technology

In view of the above-described implementations of the disclosed subject matter, this application discloses the additional examples in the clauses enumerated below. It should be noted that one feature of a clause in isolation, or more than one feature of the clause taken in combination, and, optionally, in combination with one or more features of one or more further clauses are further examples also falling within the disclosure of this application.

Clause 1. A method comprising:

(a) providing a first material comprising a porous scaffold of carbon fibrils and particles of carbon black attached to the carbon fibrils; and (b) subjecting the first material, in a first atmosphere of a gas comprising one or more organic compounds, to a first temperature (i.e., pyrolysis temperature) for a first duration, such that:

the one or more organic compounds undergo pyrolysis to form carbon and hydrogen, at least some of the formed carbon being deposited on, within, or both on and within the first material, the carbon fibrils merge to form a carbonized matrix, and the carbon black particles aggregate and/or become embedded within the carbonized matrix.

Clause 2. The method of any clause or example herein, in particular, Clause 1, wherein the one or more organic compounds comprise methane ($CH_4$), acetylene ($C_2H_2$), ethylene ($C_2H_4$), ethane ($C_2H_6$), propane ($C_3H_8$), propylene ($C_3H_6$), methylacetylene ($C_3H_4$), butane ($C+H_{10}$), butylene ($C_4H_8$), butyne ($C_4H_6$), pentane ($C_5H_{12}$), pentene ($C_5H_{10}$), pentyne ($C_5H_8$), isoprene ($C_5H_8$), hexane ($C_6H_{14}$), hexene ($C_6H_{12}$), hexyne ($C_6H_{10}$), benzene ($C_6H_6$), heptane ($C_7H_{16}$), heptene ($C_7H_{14}$), heptyne ($C_7H_{12}$), toluene ($C_7H_8$), octane ($C_8H_{18}$), octene ($C_8H_{16}$), octyne ($C_8H_{14}$), nonane ($C_9H_{20}$), nonene ($C_9H_{18}$), nonyne ($C_9H_{16}$), decane ($C_{10}H_{22}$), decene ($C_{10}H_{20}$), decyne ($C_{10}H_{18}$), naphthalene ($C_{10}H_8$), undecane ($C_{11}H_{24}$), dodecane ($C_{12}H_{26}$), variations (e.g., cycloalkanes, alkadienes, etc.) of any of the foregoing, or combinations of any of the foregoing.

Clause 3. The method of any clause or example herein, in particular, any one of Clauses 1-2, wherein the gas is methane.

Clause 4. The method of any clause or example herein, in particular, any one of Clauses 1-3, wherein the fibrils comprise polyacrylonitrile-based carbon fibrils, pitch-based carbon fibrils, lignin-based carbon fibrils, or any combination of the foregoing.

Clause 5. The method of any clause or example herein, in particular, any one of Clauses 1-4, wherein the first material is a fiber formed by the porous scaffold of fibrils with the carbon black particles dispersed therein.

Clause 6. The method of any clause or example herein, in particular, any one of Clauses 1-5, wherein the fibrils in the porous scaffold are substantially aligned along a common direction (e.g., an axial or longitudinal direction of a carbon fiber), for example, resulting from a method of producing the fiber (e.g., dry-jet wet spinning) and/or from additional fiber drawing steps.

Clause 7. The method of any clause or example herein, in particular, any one of Clauses 1-6, wherein, prior to (b), an amount of carbon black in the first material is in a range of 20-80 wt %, inclusive.

Clause 8. The method of any clause or example herein, in particular, any one of Clauses 1-7, wherein the first temperature is in a range of 1200-1800 K, inclusive, and/or the first duration is in a range of 10-30 minutes, inclusive.

Clause 9. The method of any clause or example herein, in particular, any one of Clauses 1-8, wherein the first temperature is about 1700 K, and/or the first duration is about 20 minutes.

Clause 10. The method of any clause or example herein, in particular, any one of Clauses 1-9, wherein the subjecting of (b) is such that a yield of the formed hydrogen from the one or more organic compounds is at least 80%.

Clause 11. The method of any clause or example herein, in particular, any one of Clauses 1-10, wherein:

a density of the first material after (b) is greater than that of the first material prior to (b);

a tensile strength of the first material after (b) is at least 5 times greater than that of the first material prior to (b);

a conductivity of the first material after (b) is at least 20 times greater than that of the first material prior to (b);

a thickness or diameter of the first material after (b) is greater than that of the first material prior to (b);

a porosity of the first material after (b) is less than that of the first material prior to (b);

the tensile strength of the first material after (b) is at least 400 MPa;

the conductivity of the first material is at least $1\times10^4$ S/m; or any combination of the above.

Clause 12. The method of any clause or example herein, in particular, any one of Clauses 1-11, wherein the subjecting of (b) is performed without a catalyst for pyrolysis.

Clause 13. The method of any clause or example herein, in particular, any one of Clauses 1-12, wherein the subjecting of (b) comprises Joule heating by passing an electrical current through at least a portion of the first material.

Clause 14. The method of any clause or example herein, in particular, Clause 13, wherein, during the Joule heating, at least another portion of the first material does not have electrical current passed therethrough.

Clause 15. The method of any clause or example herein, in particular, any one of Clauses 1-14, wherein the subjecting of (b) comprises:

heating by a microwave heating source, a laser, an electron beam device, a spark discharge device, or any combination thereof; and/or heating by a Joule heating element in direct contact with the first material (e.g., with facing surfaces touching) or spaced from the first material (e.g., with a gap between facing surfaces, or in indirect contact via one or more intermediate members).

Clause 16. The method of any clause or example herein, in particular, any one of Clauses 1-15, wherein the providing of (a) comprises (a1) dry-jet wet-spinning or blow-spinning to form a precursor filament, and (a2) forming the precursor filament into a carbon fiber as the first material.

Clause 17. The method of any clause or example herein, in particular, Clause 16, wherein the providing of (a2) further comprises:

(a2a) after (a1), stabilizing the precursor filament by subjecting the filament to a second temperature (i.e., stabilization temperature) for a second duration; and (a2b) after (a2a), carbonizing the precursor filament by subjecting the filament to a third temperature (i.e., carbonization temperature) for a third duration, wherein the third temperature is greater than the second temperature.

Clause 18. The method of any clause or example herein, in particular, Clause 17, wherein:

the second temperature is less than or equal to about 625 K (e.g., ~578 K);

the third temperature is less than or equal to about 1750 K (e.g., ~1588 K);

the second duration is in a range of about 10-180 minutes, inclusive, or is in a range of about 10-30 minutes, inclusive, or is about 20 minutes;

the third duration is in a range of about 5-60 minutes, inclusive, or is in a range of about 5-15 minutes, or is about 10 minutes; or any combination of the above.

Clause 19. The method of any clause or example herein, in particular, any one of Clauses 17-18, wherein:

the stabilizing of (a2a) is performed with the precursor filament in an atmosphere of air;

the carbonizing of (a2b) is performed with the filament in an inert gas atmosphere (e.g., atmosphere of nitrogen); or both of the above.

Clause 20. The method of any clause or example herein, in particular, any one of Clauses 17-19, wherein a conductivity of the carbon fiber after the carbonizing of (a2b) is greater than that of the precursor fiber prior to the stabilizing of (a2a).

Clause 21. The method of any clause or example herein, in particular, any one of Clauses 1-20, wherein (b) further comprises, prior to the subjecting to the first temperature, performing a first graphitizing by subjecting the first material, in an inert gas atmosphere (e.g., a second atmosphere comprising an inert gas), to a fourth temperature (i.e., first graphitization temperature) for a fourth duration, the fourth temperature being greater than the first temperature, the fourth duration being less than the first duration.

Clause 22. The method of any clause or example herein, in particular, Clause 21, wherein:

the fourth temperature is greater than or equal to about 2000 K, or in a range of about 2000-2773 K, inclusive;

the fourth duration is less than or equal to about 5 minutes;

the inert gas is argon; or any combination of the above.

Clause 23. The method of any clause or example herein, in particular, any one of Clauses 21-22, a crystallinity of the first material after the first graphitizing is enhanced as compared to that of the first material prior to the first graphitizing.

Clause 24. The method of any clause or example herein, in particular, any one of Clauses 1-23, wherein (b) further comprises, after the subjecting to the first temperature, performing a second graphitizing by subjecting the first material, in an inert gas atmosphere (e.g., a third atmosphere comprising an inert gas), to a fifth temperature (i.e., a second graphitization temperature) for a fifth duration, the fifth temperature being greater than the first temperature, the fifth duration being less than the first duration.

Clause 25. The method of any clause or example herein, in particular, Clause 24, wherein:

the fifth temperature is greater than or equal to about 2000 K, or in a range of about 2000-2773 K, inclusive;

the fifth duration is less than or equal to 5 minutes;

the inert gas is argon; or any combination of the above.

Clause 26. The method of any clause or example herein, in particular, any one of Clauses 24-25, wherein a quantity of $sp^2$-hybridized carbon in the first material after the second graphitizing is greater than a quantity of $sp^2$-hybridized carbon in the first material prior to the second graphitizing.

Clause 27. The method of any clause or example herein, in particular, any one of Clauses 24-26, wherein a crystallinity of the first material after the second graphitizing is enhanced as compared to that of the first material after the subjecting to the first temperature but prior to the second graphitizing.

Clause 28. The method of any clause or example herein, in particular, any one of Clauses 1-27, wherein the first material is a polyacrylonitrile-based carbon fiber with carbon black particles therein, the first atmosphere comprises methane, the first temperature is about 1600-1800 K, and the first duration is about 20 minutes.

Clause 29. The method of any clause or example herein, in particular, any one of Clauses 1-28, further comprising separating the formed hydrogen from the gas of (b), storing or transporting the formed hydrogen, or both of the foregoing.

Clause 30. A system comprising one or more processors and computer-readable storage media storing instructions that, when executed by the one or more processors, cause the system to perform the method of any clause or example herein, in particular, any one of Clauses 1-29.

Clause 31. A system comprising:

a gas enclosure constructed to contain a first atmosphere of a gas comprising one or more organic compounds;

an inlet line comprising one or more inlet flow control devices and constructed to deliver the gas to the gas enclosure;

a pair of electrodes disposed within the gas enclosure and constructed to be coupled to respective portions of one or more first materials;

a current source coupled to the pair of electrodes; and a controller operatively coupled to the one or more inlet flow control devices and the current source, the controller comprising one or more processors and computer-readable storage media storing instructions that, when executed by the one or more processors, cause the controller to:

control the one or more inlet flow control devices to provide the first atmosphere to the gas enclosure; and control the current source to pass a first electrical current through at least part of each first material via the pair of electrodes so as to subject the at least part of each first material in the first atmosphere to a first temperature (i.e., pyrolysis temperature) for a first duration, wherein the subjecting to the first temperature is such that:

the one or more organic compounds undergo pyrolysis to form carbon and hydrogen, at least some of the formed carbon being deposited on, within, or both on and within the at least part of each first material, carbon fibrils within the at least part of each first material merge to form a respective carbonized matrix, and carbon black particles within the at least part of each first material aggregate and/or become embedded within the respective carbonized matrix.

Clause 32. The system of any clause or example herein, in particular, any one of Clauses 30-31, wherein each of the electrodes comprises a conductive roller.

Clause 33. The system of any clause or example herein, in particular, any one of Clauses 30-32, further comprising one or more tension-applying servomechanisms disposed upstream of the pair of electrodes and constructed to subject at least part of the one or more first materials to tensile stress.

Clause 34. The system of any clause or example herein, in particular, any one of Clauses 30-33, further comprising:

a supply spool constructed to supply the one or more first materials to the gas enclosure;

an uptake spool constructed to receive the one or more first materials from the gas enclosure after processing; or both of the above.

Clause 35. The system of any clause or example herein, in particular, any one of Clauses 30-34, wherein the one or more organic compounds comprise methane ($CH_4$), acetylene ($C_2H_2$), ethylene ($C_2H_4$), ethane ($C_2H_6$), propane ($C_3H_8$), propylene ($C_3H_6$), methylacetylene ($C_3H_4$), butane ($C_4H_{10}$), butylene ($C_4H_8$), butyne ($C_4H_6$), pentane ($C_5H_{12}$), pentene ($C_5H_{10}$), pentyne ($C_5H_8$), isoprene ($C_5H_8$), hexane ($C_6H_{14}$), hexene ($C_6H_{12}$), hexyne ($C_6H_{10}$), benzene ($C_6H_6$), heptane ($C_7H_{16}$), heptene ($C_7H_{14}$), heptyne ($C_7H_{12}$), toluene ($C_7H_8$), octane ($C_8H_{18}$), octene ($C_8H_{16}$), octyne ($C_8H_{14}$), nonane ($C_9H_{20}$), nonene ($C_9H_{18}$), nonyne ($C_9H_{16}$), decane ($C_{10}H_{22}$), decene ($C_{10}H_{20}$), decyne ($C_{10}H_{18}$), naphthalene ($C_{10}H_8$), undecane ($C_{11}H_{24}$), dodecane ($C_{12}H_{26}$), variations (e.g., cycloalkanes, alkadienes, etc.) of any of the foregoing, or combinations of any of the foregoing.

Clause 36. The system of any clause or example herein, in particular, any one of Clauses 30-35, wherein the first temperature is in a range of about 1200-1800 K, inclusive, and/or the first duration is in a range of about 10-30 minutes, inclusive.

Clause 37. The system of any clause or example herein, in particular, any one of Clauses 30-36, wherein the first temperature is about 1700 K, and/or the first duration is about 20 minutes.

Clause 38. The system of any clause or example herein, in particular, any one of Clauses 30-37, further comprising a separation device coupled to the gas enclosure and constructed to isolate the formed hydrogen.

Clause 39. The system of any clause or example herein, in particular, any one of Clauses 30-38, wherein:

the inlet line is further constructed to deliver a second atmosphere comprising an inert gas (e.g., an inert gas atmosphere) to the gas enclosure, and the computer-readable storage media stores additional instructions that, when executed by the one or more processors, cause the controller to:

control the one or more inlet flow control devices to provide the second atmosphere to the gas enclosure prior to providing the first atmosphere; and control the current source to pass a second electrical current through at least part of each first material via the pair of electrodes so as to subject the at least part of each first material in the second atmosphere to a second temperature (i.e., first graphitization temperature) for a second duration.

Clause 40. The system of any clause or example herein, in particular, Clause 39, wherein:

the second temperature is greater than or equal to about 2000 K, or in a range of about 2000-2773 K, inclusive;

the second duration is less than or equal to about 5 minutes;

the inert gas is argon; or any combination of the above.

Clause 41. The system of any clause or example herein, in particular, any one of Clauses 30-40, further comprising:

an outlet line comprising one or more outlet flow control devices and constructed to evacuate the gas enclosure, wherein the inlet line is further constructed to deliver a third atmosphere comprising an inert gas (e.g., an inert gas atmosphere) to the gas enclosure, and the computer-readable storage media stores additional instructions that, when executed by the one or more processors, cause the controller to:

control the inlet and outlet flow control devices to replace the first atmosphere with the third atmosphere; and control the current source to pass a third electrical current through at least part of each first material via the pair of electrodes so as to subject the at least part of each first material in the third atmosphere to a third temperature (i.e., a second graphitization temperature) for a third duration.

Clause 42. The system of any clause or example herein, in particular, Clause 41, wherein:

the third temperature is greater than or equal to about 2000 K, or in a range of about 2000-2773 K, inclusive;

the third duration is less than or equal to about 5 minutes;

the inert gas is argon; or any combination of the above.

Clause 43. The system of any clause or example herein, in particular, any one of Clauses 30-42, further comprising:

a first graphitizing enclosure arranged upstream of the gas enclosure and constructed to contain a second atmosphere of an inert gas;

a second graphitizing enclosure arranged downstream of the gas enclosure and constructed to contain a third atmosphere of an inert gas; or both of the above.

Clause 44. The system of any clause or example herein, in particular, Clause 43, further comprising a conveying device configured to translate the one or more first materials through the first graphitizing enclosure, between the first graphitizing enclosure and the gas enclosure, through the gas enclosure, between the gas enclosure and the second graphitizing enclosure, through the second graphitizing enclosure, or any combination of the foregoing.

Clause 45. The system of any clause or example herein, in particular, any one of Clauses 43-44, wherein:

the first graphitizing enclosure includes a first pair of electrodes coupled to a first current source, and the computer-readable storage media stores additional instructions that, when executed by the one or more processors, cause the controller to control the first current source to pass a second electrical current through at least part of each first material via the first pair of electrodes so as to subject the at least part of each first material in the second atmosphere to a second temperature (i.e., a first graphitization temperature) for a second duration;

the second graphitizing enclosure includes a second pair of electrodes coupled to a second current source, and the computer-readable storage media stores additional instructions that, when executed by the one or more processors, cause the controller to control the second current source to pass a third electrical current through at least part of each first material via the second pair of electrodes so as to subject the at least part of each first material in the third atmosphere to a third temperature (i.e., a second graphitization temperature) for a third duration; or both of the above.

Clause 46. The system of any clause or example herein, in particular, Clause 45, wherein:

the second temperature, the third temperature, or both the second and third temperatures are greater than or equal to about 2000 K, or in a range of about 2000-2773 K, inclusive;

the second duration, the third duration, or both the second and third durations are less than or equal to about 5 minutes;

the inert gas is argon; or any combination of the above.

Clause 47. The system of any clause or example herein, in particular, any one of Clauses 30-46, further comprising a fiber fabrication station constructed to form one or more precursor filaments via dry-jet wet-spinning or blow-spinning.

Clause 48. The system of any clause or example herein, in particular, any one of Clauses 44, further comprising a furnace, wherein the controller is operatively coupled to the furnace, and the computer-readable storage media stores additional instructions that, when executed by the one or more processors, cause the controller to:

control the furnace to subject the one or more precursor filaments therein to a fourth temperature for a fourth duration, so as to stabilize the one or more precursor filaments; and/or control the furnace to subject the one or more precursor filaments therein to a fifth temperature for a fifth duration, so as to carbonize the one or more precursor filaments to form the one or more carbon fibers, the fifth temperature being greater than the fourth temperature.

Clause 49. The system of any clause or example herein, in particular, Clause 48, wherein:

the fourth temperature is less than or equal to 625 K (e.g., ~578 K);

the fifth temperature is less than or equal to 1750 K (e.g., ~1588 K);

the fourth duration is in a range of about 10-180 minutes, inclusive, or is in a range of about 10-30 minutes, inclusive, or is about 20 minutes;

the fifth duration is in a range of about 5-60 minutes, inclusive, or is in a range of about 5-15 minutes, or is about 10 minutes; or any combination of the above.

Clause 50. The system of any clause or example herein, in particular, any one of Clauses 30-49, wherein the gas enclosure comprises a quartz tube.

Clause 51. A material for fabricating an upgraded carbon fiber, comprising:

a porous scaffold of carbon fibrils; and particles of carbon black within the porous scaffold and attached to the carbon fibrils, wherein an amount of the carbon black particles within the material is in a range of 20-80 wt %, inclusive.

Clause 52. The material of any clause or example herein, in particular, Clause 51, wherein the fibrils comprise polyacrylonitrile-based carbon fibrils, pitch-based carbon fibrils, lignin-based carbon fibrils, or any combination of the foregoing.

Clause 53. An upgraded carbon fiber formed at least in part by subjecting the material of any clause or example herein, in particular, any one of Clauses 51-52, in an atmosphere of a gas comprising one or more organic compounds, to a first temperature (i.e., a pyrolysis temperature) for a first duration, the upgraded carbon fiber comprising:

a carbonized matrix formed by merged carbon fibrils of the porous scaffold; and carbon black particles embedded within the carbonized matrix.

Clause 54. The upgraded carbon fiber of any clause or example herein, in particular, any Clause 53, wherein a tensile strength of the upgraded carbon fiber is at least 400 MPa, a conductivity of the upgraded carbon fiber is at least 1×10+S/m, or both of the foregoing.

Clause 55. A method comprising:

(a) subjecting organic compounds in a gaseous state within an enclosure to a first temperature (i.e., a pyrolysis temperature), such that at least some of the organic compounds undergo pyrolysis to form carbon and hydrogen;

(b) capturing at least some of the formed carbon on, within, or both on and within a first material portion, the first material portion being disposed within the enclosure and composed of carbon; and (c) separating the formed hydrogen from a remainder of the organic compounds.

Clause 56. The method of any clause or example herein, in particular, Clause 55, wherein the organic compounds comprise methane ($CH_4$), acetylene ($C_2H_2$), ethylene ($C_2H_4$), ethane ($C_2H_6$), propane ($C_3H_8$), propylene ($C_3H_6$), methylacetylene ($C_3H_4$), butane ($C+H_{10}$), butylene ($C+H_8$), butyne ($C_4H_6$), pentane ($C_5H_{12}$), pentene ($C_5H_{10}$), pentyne ($C_5H_8$), isoprene ($C_5H_8$), hexane ($C_6H_{14}$), hexene ($C_6H_{12}$), hexyne ($C_6H_{10}$), benzene ($C_6H_6$), heptane ($C_7H_{16}$), heptene ($C_7H_{14}$), heptyne ($C_7H_{12}$), toluene ($C_7H_8$), octane ($C_8H_{18}$), octene ($C_8H_{16}$), octyne ($C_8H_{14}$), nonane ($C_9H_{20}$), nonene ($C_9H_{18}$), nonyne ($C_9H_{16}$), decane ($C_{10}H_{22}$), decene ($C_{10}H_{20}$), decyne ($C_{10}H_{18}$), naphthalene ($C_{10}H_8$), undecane ($C_{11}H_{24}$), dodecane ($C_{12}H_{26}$), variations (e.g., cycloalkanes, alkadienes, etc.) of any of the foregoing, or combinations of any of the foregoing.

Clause 57. The method of any clause or example herein, in particular, any one of Clauses 55-56, wherein the organic compounds are methane, the first material portion is part of a polyacrylonitrile-based carbon fiber with carbon black particles therein, and/or the first temperature is about 1600-1800 K.

Clause 58. The method of any clause or example herein, in particular, any one of Clauses 55-57, wherein the first material portion comprise polyacrylonitrile-based carbon fibrils, pitch-based carbon fibrils, lignin-based carbon fibrils, or any combination of the foregoing.

Clause 59. The method of any clause or example herein, in particular, Clause 58, wherein the first material portion prior to (b) further comprises particles of carbon black attached to the carbon fibrils.

Clause 60. The method of any clause or example herein, in particular, Clause 59, wherein, prior to (b), an amount of carbon black in the first material portion is in a range of about 20-80 wt %, inclusive.

Clause 61. The method of any clause or example herein, in particular, any one of Clauses 55-60, wherein the first temperature is in a range of about 1200-1800 K, inclusive.

Clause 62. The method of any clause or example herein, in particular, any one of Clauses 55-61, wherein the first temperature is about 1700 K.

Clause 63. The method of any clause or example herein, in particular, any one of Clauses 55-62, wherein a yield of the formed hydrogen from the organic compounds is at least 80%.

Clause 64. The method of any clause or example herein, in particular, any one of Clauses 55-63, wherein (a) is performed without a catalyst for pyrolysis.

Clause 65. The method of any clause or example herein, in particular, any one of Clauses 55-64, wherein the subjecting of (a) comprises Joule heating by passing an electrical current through at least part of the first material portion.

Clause 66. The method of any clause or example herein, in particular, any one of Clauses 55-65, wherein the subjecting of (a) comprises heating by a Joule heating element in direct contact with or spaced from the first material portion, a microwave heating source, a laser, an electron beam device, a spark discharge device, or any combination thereof.

Clause 67. The method of any clause or example herein, in particular, any one of Clauses 55-66, further comprising, at a first time after initiation of (a), replacing the first material portion with a fresh, new, or different first material portion, and repeating (a)-(c).

Clause 68. The method of any clause or example herein, in particular, any one of Clauses 55-67, wherein the first material portion comprises a porous scaffold of carbon fibrils.

Clause 69. The method of any clause or example herein, in particular, any one of Clauses 55-68, wherein the first material portion is part of a carbon fiber.

CONCLUSION

Any of the features illustrated or described herein, for example, with respect to FIGS. 1A-13B and Clauses 1-69, can be combined with any other feature illustrated or described herein, for example, with respect to FIGS. 1A-13B and Clauses 1-69 to provide carbon materials, systems, devices, structures, methods, and embodiments not otherwise illustrated or specifically described herein. All features described herein are independent of one another and, except where structurally impossible, can be used in combination with any other feature described herein. In view of the many possible embodiments to which the principles of the disclosed technology may be applied, it should be recognized that the illustrated embodiments are only examples and should not be taken as limiting the scope of the disclosed technology. Rather, the scope is defined by the following claims. We therefore claim all that comes within the scope and spirit of these claims.

The invention claimed is:

1. A method comprising:

(a) providing a first material comprising a porous scaffold of carbon fibrils and particles of carbon black attached to the carbon fibrils; and (b) subjecting the first material, in a first atmosphere of a gas comprising one or more organic compounds, to a pyrolysis temperature for a first duration, such that:

the one or more organic compounds undergo pyrolysis to form carbon and hydrogen, at least some of the formed carbon being deposited on, within, or both on and within the first material, the carbon fibrils merge to form a carbonized matrix, and the carbon black particles become embedded within the carbonized matrix.

2. The method of claim 1, wherein the one or more organic compounds comprise methane ($CH_4$), acetylene ($C_2H_2$), ethylene ($C_2H_4$), ethane ($C_2H_6$), propane ($C_3H_8$), propylene ($C_3H_6$), methylacetylene ($C_3H_4$), butane ($C_4H_{10}$), butylene ($C_4H_8$), butyne ($C_4H_6$), pentane ($C_5H_{12}$), pentene ($C_5H_{10}$), pentyne ($C_5H_8$), isoprene ($C_5H_8$), hexane ($C_6H_{14}$), hexene ($C_6H_{12}$), hexyne ($C_6H_{10}$), benzene ($C_6H_6$), heptane ($C_7H_{16}$), heptene ($C_7H_{14}$), heptyne ($C_7H_{12}$), toluene ($C_7H_8$), octane ($C_8H_{18}$), octene ($C_8H_{16}$), octyne ($C_8H_{14}$), nonane ($C_9H_{20}$), nonene ($C_9H_{18}$), nonyne ($C_9H_{16}$), decane ($C_{10}H_{22}$), decene ($C_{10}H_{20}$), decyne ($C_{10}H_{18}$), naphthalene ($C_{10}H_8$), undecane ($C_{11}H_{24}$), dodecane ($C_{12}H_{26}$), variations of any of the foregoing, or combinations of any of the foregoing.

3. The method of claim 1, wherein the fibrils comprise polyacrylonitrile-based carbon fibrils, pitch-based carbon fibrils, lignin-based carbon fibrils, or any combination of the foregoing.

4. The method of claim 1, wherein the first material is a fiber formed by the porous scaffold of fibrils with the carbon black particles dispersed therein.

5. The method of claim 1, wherein the fibrils in the porous scaffold are substantially aligned.

6. The method of claim 1, wherein, prior to (b), an amount of carbon black in the first material is in a range of 20-80 wt %, inclusive.

7. The method of claim 1, wherein the pyrolysis temperature is in a range of 1200-1800 K, inclusive, and/or the first duration is in a range of 10-30 minutes, inclusive.

8. The method of claim 1, wherein the subjecting of (b) is such that a yield of the formed hydrogen from the one or more organic compounds is at least 80%.

9. The method of claim 1, wherein the subjecting of (b) is performed without a catalyst for pyrolysis.

10. The method of claim 1, wherein the subjecting of (b) comprises Joule heating by passing an electrical current through at least a portion of the first material.

11. The method of claim 1, wherein the subjecting of (b) comprises heating by a Joule heating element in direct contact with or spaced from the first material, a microwave heating source, a laser, an electron beam device, a spark discharge device, or any combination thereof.

12. The method of claim 1, wherein the first material is a polyacrylonitrile-based carbon fiber with carbon black particles therein, the first atmosphere comprises methane, the pyrolysis temperature is about 1600-1800 K, and the first duration is about 20 minutes.

13. The method of claim 1, further comprising:

separating the formed hydrogen from the gas of (b);

storing or transporting the formed hydrogen; or both of the above.

14. A system comprising:

a gas enclosure constructed to contain a first atmosphere of a gas comprising one or more organic compounds;

an inlet line comprising one or more inlet flow control devices and constructed to deliver the gas to the gas enclosure;

a pair of electrodes disposed within the gas enclosure and constructed to be coupled to respective portions of one or more first materials;

a current source coupled to the pair of electrodes; and a controller operatively coupled to the one or more inlet flow control devices and the current source, the controller comprising one or more processors and computer-readable storage media storing instructions that, when executed by the one or more processors, cause the controller to:

control the one or more inlet flow control devices to provide the first atmosphere to the gas enclosure; and control the current source to pass a first electrical current through at least part of each first material via the pair of electrodes so as to subject the at least part of each first material in the first atmosphere to a pyrolysis temperature for a first duration, wherein the subjecting to the pyrolysis temperature is such that:

the one or more organic compounds undergo pyrolysis to form carbon and hydrogen, at least some of the formed carbon being deposited on, within, or both on and within the at least part of each first material, carbon fibrils within the at least part of each first material merge to form a respective carbonized matrix, and carbon black particles within the at least part of each first material become embedded within the respective carbonized matrix.

15. The system of claim 14, wherein each of the electrodes comprises a conductive roller.

16. The system of claim 14, further comprising one or more tension-applying servomechanisms disposed upstream of the pair of electrodes and constructed to subject at least part of the one or more first materials to tensile stress.

17. The system of claim 14, further comprising:

a supply spool constructed to supply the one or more first materials to the gas enclosure;

an uptake spool constructed to receive the one or more first materials from the gas enclosure after processing; or both of the above.

18. The system of claim 14, further comprising a separation device coupled to the gas enclosure and constructed to isolate the formed hydrogen.

19. The system of claim 14, wherein:

the inlet line is further constructed to deliver a second atmosphere comprising an inert gas to the gas enclosure, and the computer-readable storage media stores additional instructions that, when executed by the one or more processors, cause the controller to:

control the one or more inlet flow control devices to provide the second atmosphere to the gas enclosure prior to providing the first atmosphere; and control the current source to pass a second electrical current through at least part of each first material via the pair of electrodes so as to subject the at least part of each first material in the second atmosphere to a first graphitization temperature for a second duration.

20. The system of claim 14, further comprising a fiber fabrication station constructed to form one or more precursor filaments as the one or more first materials via dry-jet wet-spinning or blow-spinning.

* * * * *